US010240878B1

(12) United States Patent
Hefer et al.

(10) Patent No.: US 10,240,878 B1
(45) **Date of Patent: *Mar. 26, 2019**

(54) KINETIC MAGAZINE LOADER

(71) Applicant: Vista Outdoor Operations LLC, Farmington, UT (US)

(72) Inventors: Brandon Thomas Hefer, St. Louis, MO (US); Brandon Karl Trostrud, St. Louis, MO (US); Sean Higgs, St. Louis, MO (US)

(73) Assignee: VISTA OUTDOOR OPERATIONS LLC, Farmington, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/983,881

(22) Filed: May 18, 2018

Related U.S. Application Data

(63) Continuation of application No. 15/685,704, filed on Aug. 24, 2017, now Pat. No. 9,976,826.

(60) Provisional application No. 62/378,707, filed on Aug. 24, 2016.

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/82
USPC ..... 42/87; 89/33.1
See application file for complete search history.

(56) References Cited

U.S. PATENT DOCUMENTS

| | | | |
|---|---|---|---|
| 1,786,537 | A | 12/1930 | Holek |
| 1,840,477 | A | 1/1932 | Frommer |
| 2,014,177 | A | 9/1935 | Herlach et al. |
| 2,137,491 | A | 11/1938 | Huff |
| 2,191,130 | A | 2/1940 | Ludwig |
| 2,210,931 | A | 8/1940 | Harris |
| 2,345,593 | A | 4/1944 | Garand |
| 2,362,109 | A | 11/1944 | Whitmore |
| 2,394,033 | A | 2/1946 | Wossum |
| 2,403,012 | A | 7/1946 | McPheters |
| 2,451,521 | A | 10/1948 | Uglum |
| 2,452,600 | A | 11/1948 | Pool et al. |
| 2,462,836 | A | 3/1949 | Barker et al. |
| 2,466,017 | A | 4/1949 | Farber |
| 2,493,048 | A | 1/1950 | Wangrow |
| 2,514,277 | A | 7/1950 | Donallan |
| 2,531,387 | A | 11/1950 | Bilodeau |
| 2,659,173 | A | 11/1953 | Capito |
| 2,783,570 | A | 3/1957 | Kunz |
| 2,803,985 | A | 8/1957 | Hull |
| 2,830,498 | A | 4/1958 | Maillard |
| 2,834,137 | A | 5/1958 | Kunz |

(Continued)

*Primary Examiner* — J. Woodrow Eldred
(74) *Attorney, Agent, or Firm* — Seyfarth Shaw LLP; Brian Michaelis

(57) ABSTRACT

An apparatus for loading cartridges into a magazine comprises a setting mechanism including a sleeve, a body, a setting tool, and a link. The body may be slidingly disposed about the sleeve so that the body and the sleeve can slide relative to one another along a sliding axis. The body may translate between an upper position and a lower position along the sliding axis. A first end of the setting tool may be pivotally coupled to the sleeve for relative rotation between the setting tool and the sleeve about a forward axis. The setting tool rotates about the forward axis as the body translates between the upper position and the lower position.

15 Claims, 37 Drawing Sheets

(56) References Cited

U.S. PATENT DOCUMENTS

| | | | |
|---|---|---|---|
| 2,856,720 | A | 10/1958 | Kunz |
| 2,862,324 | A | 12/1958 | Ball |
| 2,885,811 | A | 5/1959 | Womble, Jr. |
| 2,887,811 | A | 5/1959 | Johnson, Jr. |
| 3,045,525 | A | 7/1962 | Stadelmann |
| 3,509,655 | A | 5/1970 | Wilhelm |
| 3,526,028 | A | 9/1970 | Winch |
| 3,710,497 | A | 1/1973 | Musgrave |
| 3,789,531 | A | 2/1974 | Kersten |
| 3,854,232 | A | 12/1974 | Musgrave |
| 3,939,590 | A | 2/1976 | Musgrave |
| 3,991,501 | A | 11/1976 | Larsson |
| 4,152,857 | A | 5/1979 | Ketterer |
| 4,291,483 | A | 9/1981 | Musgrave |
| 4,304,062 | A | 12/1981 | Pepe et al. |
| 4,352,254 | A | 10/1982 | Peter et al. |
| 4,392,321 | A | 7/1983 | Bosworth |
| 4,425,834 | A | 1/1984 | Lohmann |
| 4,452,002 | A | 6/1984 | Musgrave |
| 4,464,855 | A | 8/1984 | Musgrave |
| 4,488,371 | A | 12/1984 | Boyles |
| 4,538,371 | A | 9/1985 | Howard |
| D282,680 | S | 2/1986 | Boyles |
| 4,570,371 | A | 2/1986 | Mears |
| 4,574,511 | A | 3/1986 | Csongor |
| 4,614,052 | A | 9/1986 | Brown et al. |
| 4,688,344 | A | 8/1987 | Kim |
| 4,689,909 | A | 9/1987 | Howard |
| 4,706,402 | A | 11/1987 | Csongor |
| 4,707,941 | A | 11/1987 | Eastman |
| 4,719,715 | A | 1/1988 | Howard |
| 4,736,667 | A | 4/1988 | Kochevar et al. |
| 4,739,572 | A | 4/1988 | Brandenburg |
| D300,549 | S | 4/1989 | Crow |
| 4,827,651 | A | 5/1989 | Conkey |
| 4,829,693 | A | 5/1989 | Holmes |
| 4,872,279 | A | 10/1989 | Boat |
| 4,879,829 | A | 11/1989 | Miller et al. |
| 4,888,902 | A | 12/1989 | Knowles |
| 4,939,862 | A | 7/1990 | Brandenburg et al. |
| 4,949,495 | A | 8/1990 | Mari |
| 4,970,820 | A | 11/1990 | Miller et al. |
| 4,993,180 | A | 2/1991 | Upchurch |
| 5,074,070 | A | 12/1991 | Kuykendall |
| 5,129,173 | A | 7/1992 | Kuykendall |
| 5,249,386 | A | 10/1993 | Switzer |
| 5,301,449 | A | 4/1994 | Jackson |
| 5,355,606 | A | 10/1994 | Origoni |
| 5,377,436 | A | 1/1995 | Switzer |
| 5,402,594 | A | 4/1995 | Switzer |
| 5,417,003 | A | 5/1995 | Claveau |
| 5,669,171 | A | 9/1997 | Sally |
| D423,628 | S | 4/2000 | Smart et al. |
| 6,178,683 | B1 | 1/2001 | Williams |
| 6,189,254 | B1 | 2/2001 | Steitz |
| 6,219,953 | B1 | 4/2001 | Bentley |
| 6,286,243 | B1 | 9/2001 | Hinton |
| D477,047 | S | 7/2003 | Springer |
| 6,678,985 | B2 | 1/2004 | Pikula |
| 6,807,764 | B1 | 10/2004 | Phillips |
| 6,810,616 | B2 | 11/2004 | Tal et al. |
| 6,817,134 | B2 | 11/2004 | Newman |
| 7,059,077 | B2 | 6/2006 | Tal et al. |
| 7,257,919 | B1 | 8/2007 | Farley |
| 7,383,657 | B2 | 6/2008 | Pikielny |
| 7,487,613 | B2 | 2/2009 | Taylor |
| 7,503,138 | B2 | 3/2009 | Tal et al. |
| D604,792 | S | 11/2009 | Stanley |
| 7,637,048 | B2 | 12/2009 | Tal et al. |
| 7,805,874 | B2 | 10/2010 | Tal et al. |
| 8,065,830 | B2 | 11/2011 | Twardy |
| 8,234,810 | B2 | 8/2012 | Lee, III |
| 8,356,441 | B2 | 1/2013 | Meinel |
| 8,453,366 | B2 | 6/2013 | Gray |
| 8,484,874 | B2 | 7/2013 | Kim |
| D700,266 | S | 2/2014 | Tal et al. |
| 8,650,792 | B1 | 2/2014 | Overmars |
| 8,726,561 | B1 | 5/2014 | Hampton |
| 8,915,007 | B1 | 12/2014 | Williams |
| 8,931,199 | B1 | 1/2015 | Cauley, Jr. et al. |
| D728,065 | S | 4/2015 | Tal et al. |
| 9,003,687 | B2 | 4/2015 | Cauley, Jr. et al. |
| 9,057,570 | B1 | 6/2015 | Tal et al. |
| 9,091,500 | B1 | 7/2015 | Kim |
| 9,115,943 | B1 | 8/2015 | Jordan |
| 9,182,185 | B2 | 11/2015 | Hatch |
| 9,212,859 | B1 | 12/2015 | Tal et al. |
| 9,239,198 | B2 | 1/2016 | McPhee |
| 9,273,917 | B1 | 3/2016 | Buckner |
| D753,781 | S | 4/2016 | Cauley, Jr. et al. |
| 9,303,934 | B1 | 4/2016 | Kazsuk |
| D755,325 | S | 5/2016 | Cauley, Jr. et al. |
| 9,347,722 | B1 * | 5/2016 | Morris ..... F41A 9/83 |
| D770,588 | S | 11/2016 | Cauley, Jr. et al. |
| D818,554 | S | 5/2018 | Hefer et al. |
| D821,534 | S | 6/2018 | Couie |
| 2003/0046854 | A1 | 3/2003 | Urchek |
| 2003/0226306 | A1 | 12/2003 | Hines |
| 2004/0159035 | A1 | 8/2004 | Newman |
| 2007/0017140 | A1 | 1/2007 | Pikielny |
| 2007/0107291 | A1 | 5/2007 | Tal et al. |
| 2007/0137086 | A1 | 6/2007 | Price |
| 2008/0184608 | A1 * | 8/2008 | Tal ..... F41A 9/83 42/87 |
| 2012/0192477 | A1 | 8/2012 | Kim |
| 2012/0222343 | A1 | 9/2012 | Kim |
| 2013/0061505 | A1 | 3/2013 | Faifer |
| 2013/0232843 | A1 | 9/2013 | Bajuelo |
| 2014/0033592 | A1 | 2/2014 | Fiorucci |
| 2014/0223792 | A1 | 8/2014 | Socivoi |
| 2014/0298704 | A1 | 10/2014 | Niccum |
| 2014/0311008 | A1 | 10/2014 | McPhee |
| 2015/0316341 | A1 | 11/2015 | Aguilar |
| 2015/0377573 | A1 | 12/2015 | Niccum |
| 2016/0025437 | A1 | 1/2016 | Slocum |
| 2016/0102932 | A1 | 4/2016 | Cobb |
| 2017/0051992 | A1 | 2/2017 | Cottrell et al. |
| 2017/0211902 | A1 * | 7/2017 | Mills ..... F41A 9/83 |

* cited by examiner

FIG. 11D
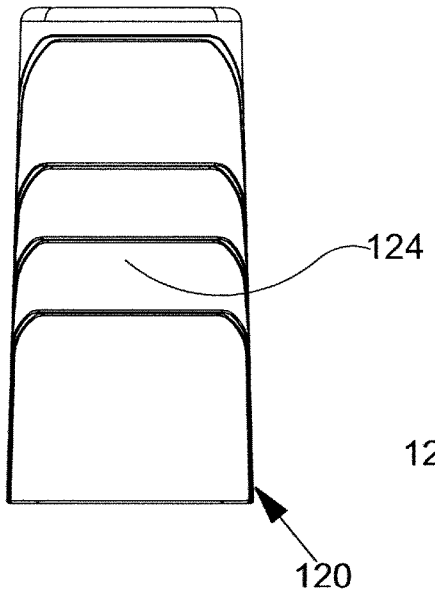
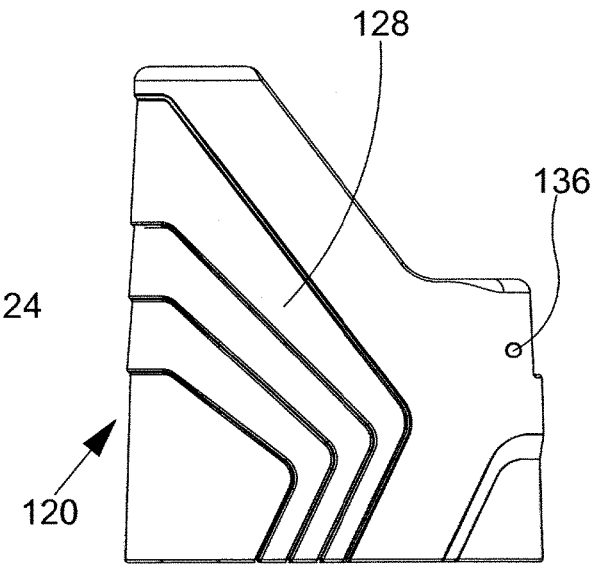
FIG. 11E
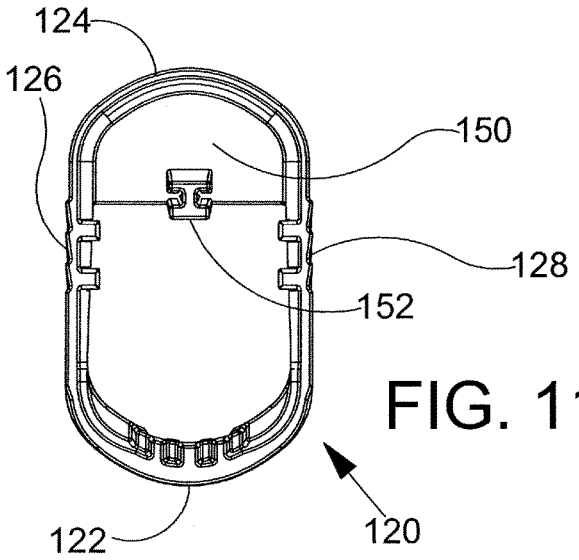
FIG. 11F

FIG. 12C
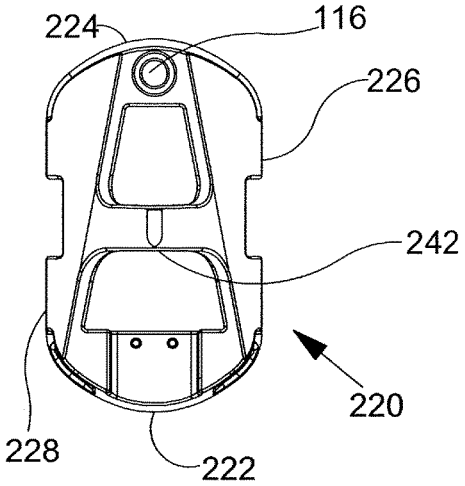
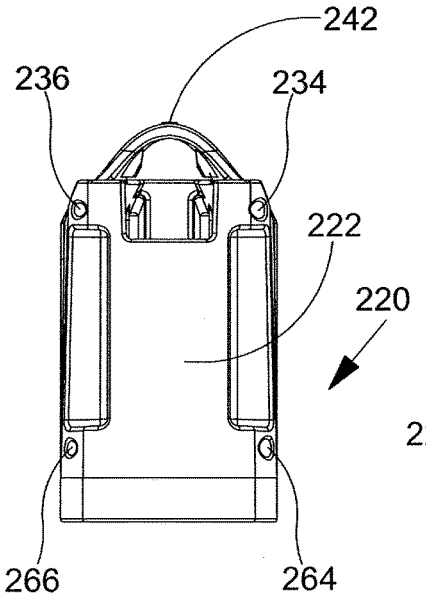
FIG. 12A
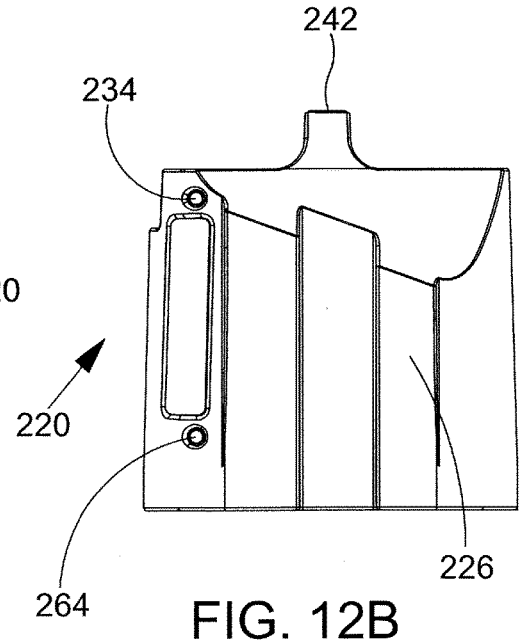
FIG. 12B

FIG. 12D
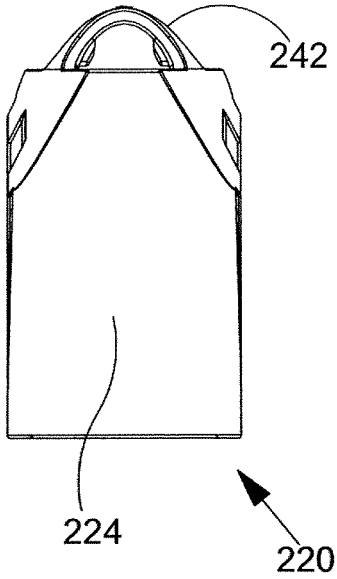
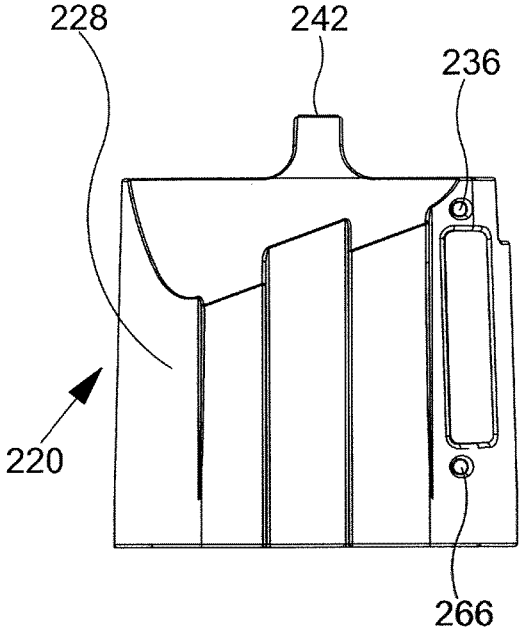
FIG. 12E
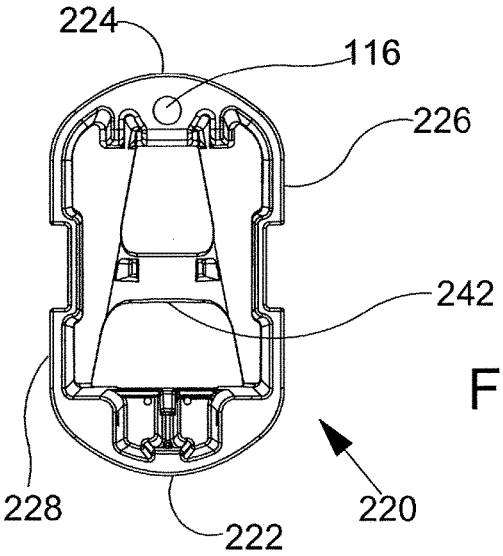
FIG. 12F

KINETIC MAGAZINE LOADER

CROSS-REFERENCE TO RELATED APPLICATIONS

This application is a continuation of U.S. patent application Ser. No. 15/685,704 filed Aug. 24, 2017 which claims the benefit of U.S. Provisional Patent Application No. 62/378,707, filed Aug. 24, 2016, the disclosures of which are incorporated by reference herein.

BACKGROUND OF THE DISCLOSURE

In order to maintain their proficiency with various types of firearms, military personnel, law enforcement officers and hunters frequently engage in target practice. Target practice is often performed at a shooting range with 300 or more cartridges being fired at each practice session. In the sport of hunting, marksmanship is practiced so that a shot can be carefully placed to ensure a quick, clean and humane kill. For military personnel, good marksmanship may make the difference between victory and defeat in battlefield situations.

Many firearms, including pistols and rifles, are designed to utilize a removable magazine that holds ammunition cartridges. The use of a magazine allows a plurality of cartridges to be easily loaded into the firearm by inserting a single magazine into the firearm. After each cartridge is fired, a manually or automatically operated mechanism moves the bolt of the firearm backward and then forward again. The upper most cartridge in the magazine is pulled off of a stack of cartridges each time the mechanism cycles so that cartridges are fed one-by-one into the firing chamber of the firearm. Each magazine typically has an elongate housing defining a chamber with a spring loaded follower slidably disposed therein. The force of the spring loaded follower urges each cartridge in the magazine toward the upper most position in the where the bolt can push it into the firing chamber. When all of the cartridges have been fired, the empty magazine is removed from the firearm and a new magazine is inserted in its place. The empty magazine may then be refilled with cartridges.

SUMMARY

An apparatus for loading cartridges into a magazine may comprise a setting mechanism including a sleeve, a body, a setting tool and a link. The sleeve may comprise a plurality of sleeve wall portions defining a sleeve cavity. In some useful embodiments, the sleeve cavity is configured to receive an upper portion of the magazine and the sleeve cavity extends along a magazine insertion and withdrawal axis. In some embodiments, the body is slidingly disposed about the sleeve so that the body and the sleeve can slide relative to one another along a sliding axis, the sliding axis extending in upward and downward directions. The body may translate between an upper position and a lower position along the sliding axis in some embodiments. In some embodiments, the body comprises a plurality of body wall portions and the plurality of body wall portions define an interior volume of the body. A first end of the setting tool may be pivotally coupled to the sleeve for rotation of the setting tool with respect to the sleeve about a first axis. A second end of the setting tool may be pivotally coupled to a first end of the link for relative rotation between the setting tool and the link about a second axis. A second end of the link may be pivotally coupled to the body for rotation of the link with respect to the body about a third axis. In some useful embodiments, when the body translates upwardly with respect to the sleeve, the setting tool rotates about the first axis and a cartridge engagement portion of the setting tool swings inwardly in a cartridge insertion motion as the body translates between the lower position and the upper position.

A method for loading cartridges into a magazine may include providing an apparatus, the apparatus comprising a sleeve defining a sleeve cavity configured to receive an upper portion of the magazine, a body slidingly disposed about the sleeve, and a setting tool having a first end pivotally coupled to the sleeve for rotation about a first axis. An upper portion of the magazine may be inserted into the sleeve cavity. The body may be urged to translate downwardly whereby the setting tool rotates about the first axis and a cartridge engaging portion of the setting tool swings outwardly as the body translates downwardly. One end of a cartridge may be insert through an opening defined by the body. The body may be allowed to translate upwardly, wherein the setting tool rotates about the first axis and the cartridge engagement portion of the setting tool swings inwardly in a cartridge insertion motion as the body translates upwardly.

In some embodiments, the magazine loader comprises a body including a starboard body wall portion, a port body wall portion, and a front body wall portion disposed opposite a rear body wall portion. The starboard body wall portion extends between the rear body wall portion and the front body wall portion. The port side body wall portion extends opposite the starboard body wall portion between the rear body wall portion and the front body wall portion. The body wall portions define an interior volume of the body. The body also includes a panel extending between an upper portion of the starboard body wall portion and an upper portion of the port body wall portion. The panel carries a post that is configured to apply downwardly directed forces to a stack of cartridges in the magazine.

The magazine loader also comprises a sleeve that is at least partially disposed inside the interior volume defined by the wall portions of the body. The sleeve comprises a front sleeve wall portion disposed opposite a rear sleeve wall portion and a starboard sleeve wall portion disposed opposite a port sleeve wall portion. The starboard sleeve wall portion extends between the rear sleeve wall portion and the front sleeve wall portion. The port sleeve wall portion extends between the rear sleeve wall portion and the front sleeve wall portion opposite the starboard sleeve wall portion. The inner surfaces of the sleeve wall portions define a sleeve cavity that is dimensioned and adapted to receive and upper portion of the magazine. An outer surface of the starboard sleeve wall portion defines a starboard channel and an outer surface of the port sleeve wall portion defines a port channel.

The starboard body wall portion comprises a starboard inner surface, a first starboard rib projecting beyond the inner surface and a second starboard rib projecting beyond the starboard inner surface. The first starboard rib and the second starboard rib of the starboard body wall portion extend into the starboard channel defined by the outer surface of the port sleeve wall portion. The port side body wall portion comprises a port inner surface, a first port rib projecting beyond the port inner surface and a second port rib projecting beyond the port inner surface. The first port rib and the second port rib of the port body wall portion extend into the port channel defined by the outer surface of the port sleeve wall portion.

The sleeve further comprises a bridge extending between an upper portion of the starboard sleeve wall portion and an upper portion of the port sleeve wall portion. The front sleeve wall portion defines a sleeve notch. The front sleeve wall portion also defines a first lumen disposed on a first side of the sleeve notch and a second lumen disposed on a second side of the sleeve notch.

A setting tool of the magazine loader is pivotally coupled to the front sleeve wall portion at a shaft. The setting tool defines a first hole and a second hole. The setting tool is positioned so that the first hole is inside the sleeve notch defined by the front sleeve wall portion. The shaft extends through the first lumen defined by the front sleeve wall portion, through the first hole defined by the setting tool and through the second lumen defined by the front sleeve wall portion.

The magazine loader also includes a spring. The spring comprises length of wire. The wire of the spring forming a first arm, a second arm and a first coil disposed between the first arm and the second arm. The coil defines a lumen. The coil is disposed about the shaft with the shaft extending through the lumen defined by the coil. The front body wall portion defines a cut-out, a first bore disposed on a first side of the cut-out and a second bore disposed on a second side of the cut-out.

A link of the magazine loader is pivotally coupled to the setting tool at a pin proximate a first end of the link. The link is pivotally coupled to the front body wall portion proximate a second end of the link. The link defines a first aperture. The link is positioned so that the first aperture is inside the cut-out defined by the front body wall portion. A dowel extends through the first bore defined by the front body wall portion, the first aperture defined by the link and the second bore defined by the front body wall portion.

A feature and advantage of embodiments is a magazine loader including a mechanism that urges cartridges into place in a magazine so that pressing with the users fingers is unnecessary. Thus avoiding abrasions, nicks, cuts, and pain that may be experienced by a user when repetitively pressing cartridges into place using fingers is avoided.

A feature and advantage of embodiments is a magazine loader in which the force that compresses the magazine spring is provided by the larger muscles in the arm rather than the smaller muscles in the hand. Using the larger muscles of the arm rather than the smaller muscles in the hand helps to avoid muscle fatigue and possible strain or injury to the hand muscles.

A feature and advantage of embodiments is a magazine loader in which the force used to move individual cartridges under the ledges of the magazine is provided by a spring rather than being provided by the muscles in the users of the hand. Using the force provided by the spring rather than the muscles in the hand helps to avoid muscle fatigue and possible strain or injury to the hand muscles.

A feature and advantage of embodiments involves providing a magazine loader that is capable of receiving magazines from handguns of various makes and models without requiring a user to make adjustments to the magazine loader. A cavity of the magazine loader has sufficient clearance around each magazine to provide a multi-magazine fit. For example, a user can load magazines from multiple handguns of different makes and/or models during a visit to a firing range. A lever is disposed inside the cavity defined by the sleeve of the magazine loader. The lever urges the magazine against the forward wall portion of the sleeve.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

FIGS. 8A-8C may be collectively referred to as FIG. 8.

FIGS. 9A-9C may be collectively referred to as FIG. 9.

FIG. 11D is a rear view of the magazine loader body shown in FIG. 11A.

FIG. 11E is a left side view of the magazine loader body shown in FIG. 11A.

FIG. 11F is a bottom view of the magazine loader body shown in FIG. 11A. FIGS. 11A-11F may be collectively referred to as FIG. 11.

FIG. 12A is a front view of a magazine loader sleeve.

FIG. 12B is a right side view of the magazine loader sleeve shown in FIG. 12A.

FIG. 12C is a top view of the magazine loader sleeve shown in FIG. 12A.

FIG. 12D is a rear view of the magazine loader sleeve shown in FIG. 12A.

FIG. 12E is a left side view of the magazine loader sleeve shown in FIG. 12A.

FIG. 12F is a bottom view of the magazine loader sleeve shown in FIG. 12A. FIGS. 12A-12F may be collectively referred to as FIG. 12.

FIGS. 13A-13F may be collectively referred to as FIG. 13.

FIGS. 14A-14F may be collectively referred to as FIG. 14.

FIGS. 27A-27C may be collectively referred to as FIG. 27.

Figure 1:
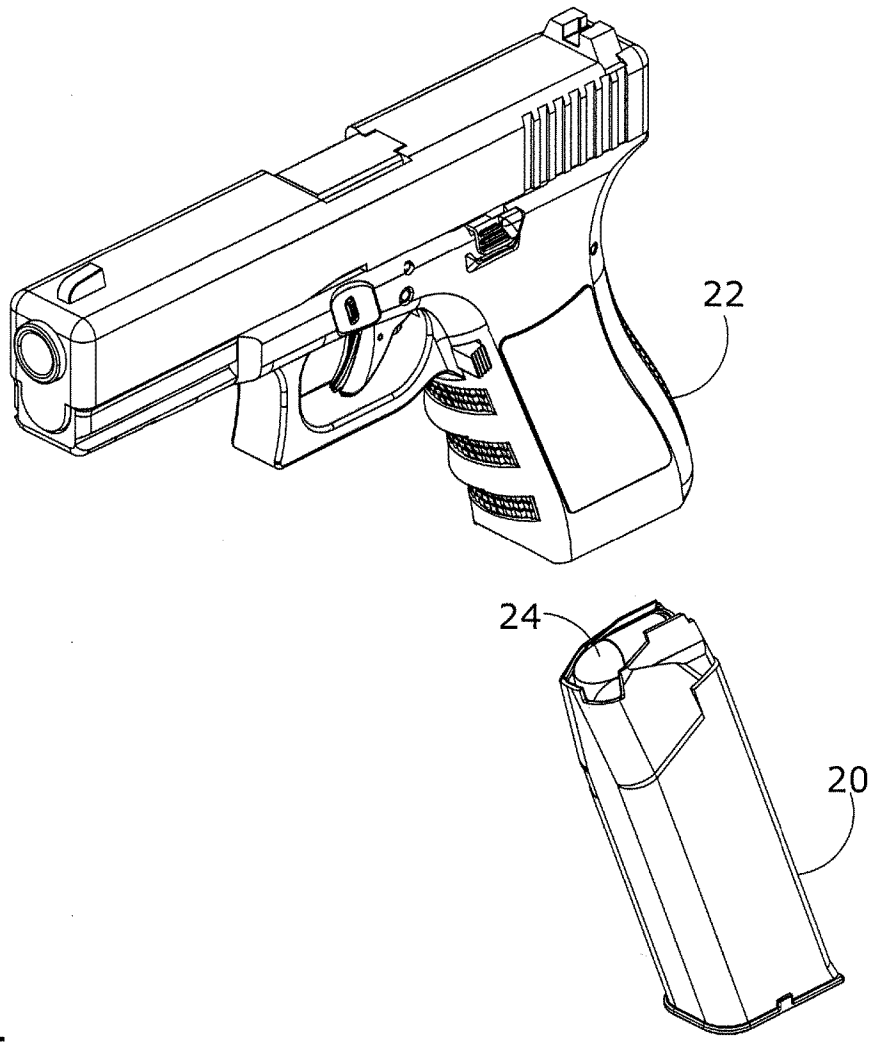
FIG. 1 is a perspective view showing a handgun and a magazine containing a stack of cartridges.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Figure 2B:
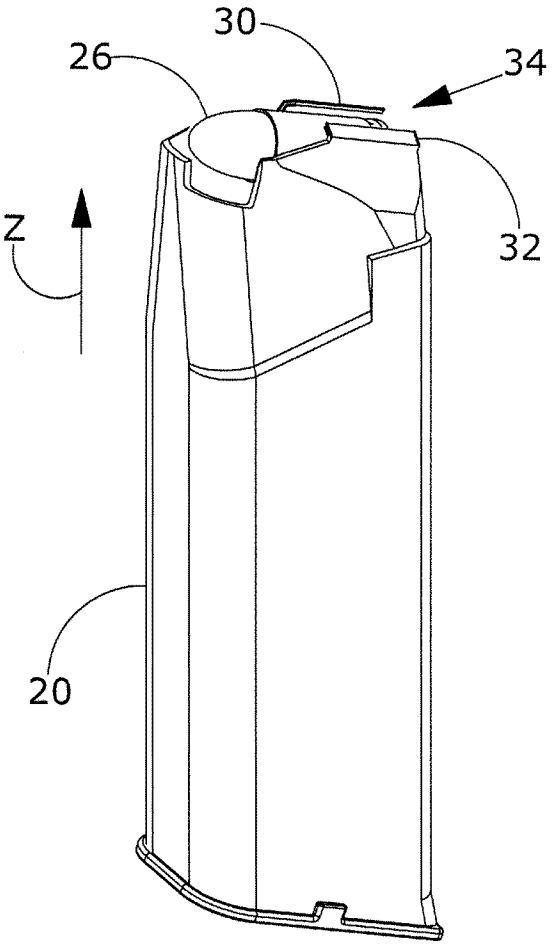
FIG. 2B is a perspective view of a magazine holding a stack of cartridges including an upper most cartridge.
Figure 2A:
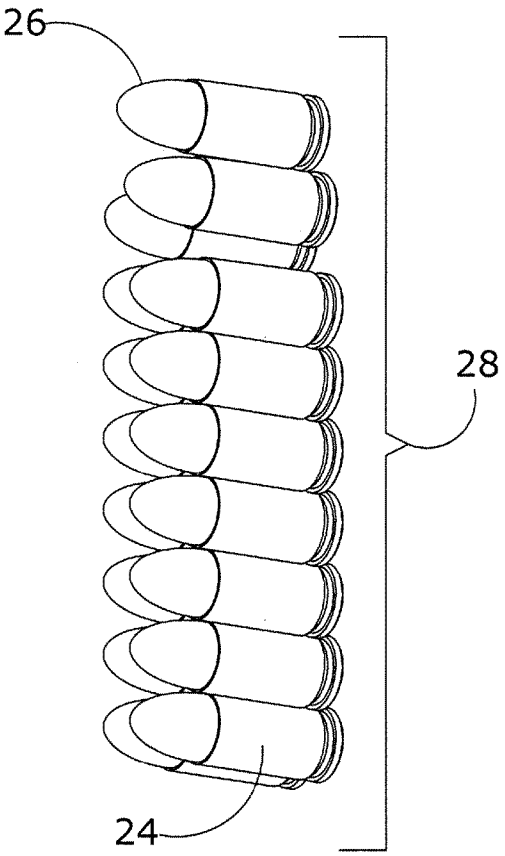
FIG. 2A is a perspective view showing a stack of cartridges including an upper most cartridge and a plurality of additional cartridges.
Figure 3:
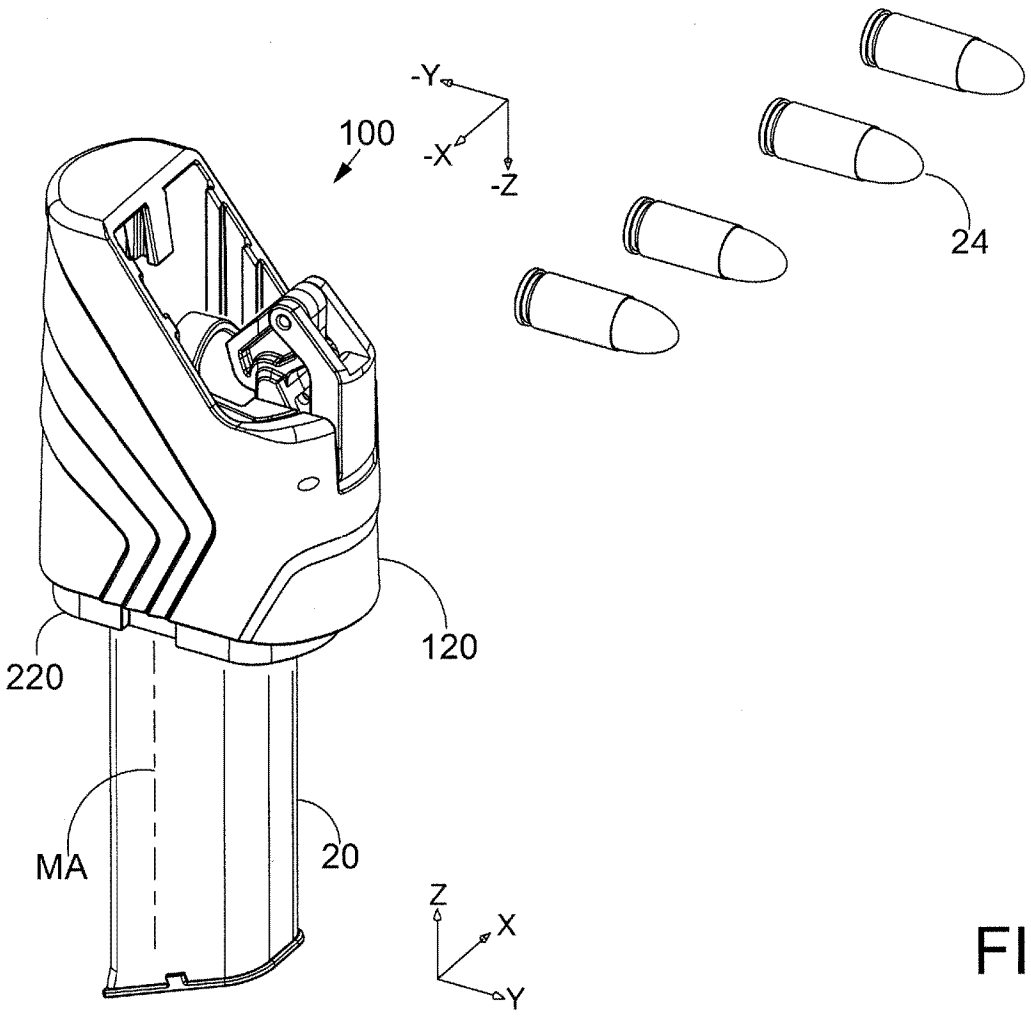
FIG. 3 is a perspective view showing a magazine loader and a magazine.
Figure 4B:
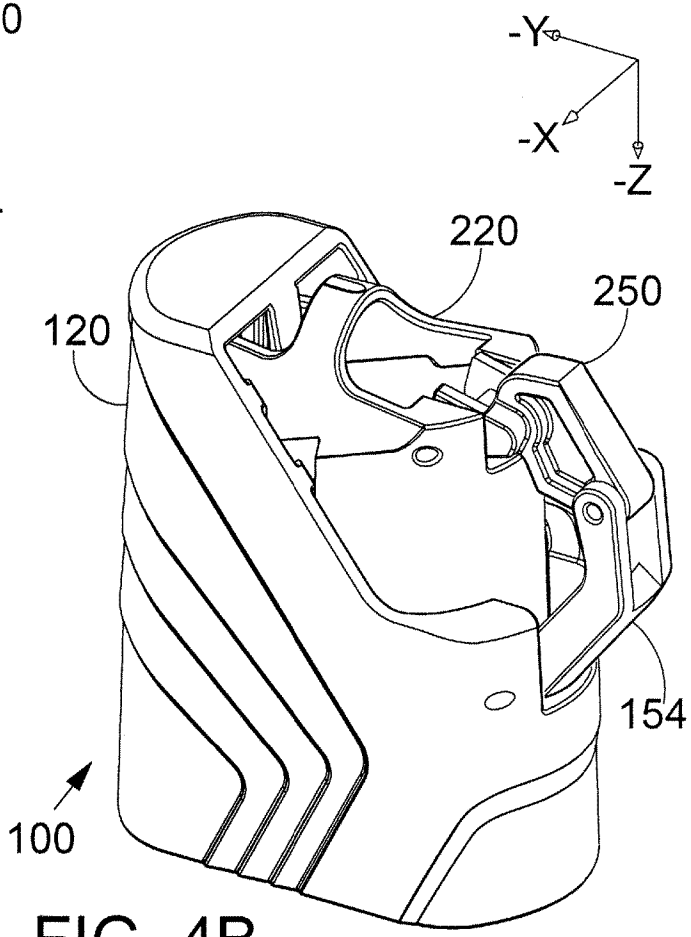
FIG. 4A and FIG. 4B are perspective views of a magazine loader in accordance with the present invention. The magazine loader is in a cartridge receiving state in FIG. 4B and the magazine loader is in a cartridge seating state in FIG. 4A.
Figure 4A:
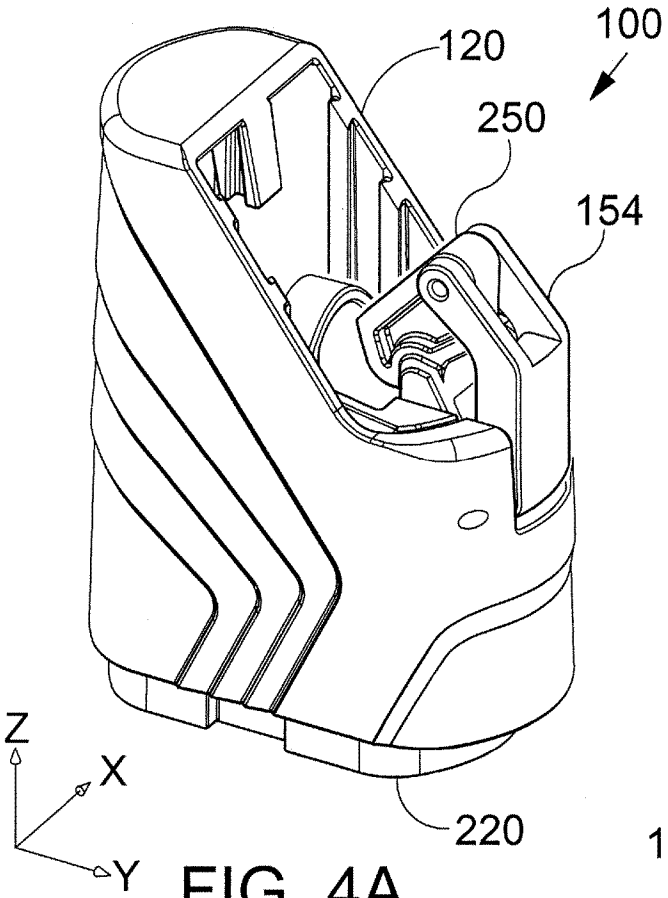
Figure 5A:
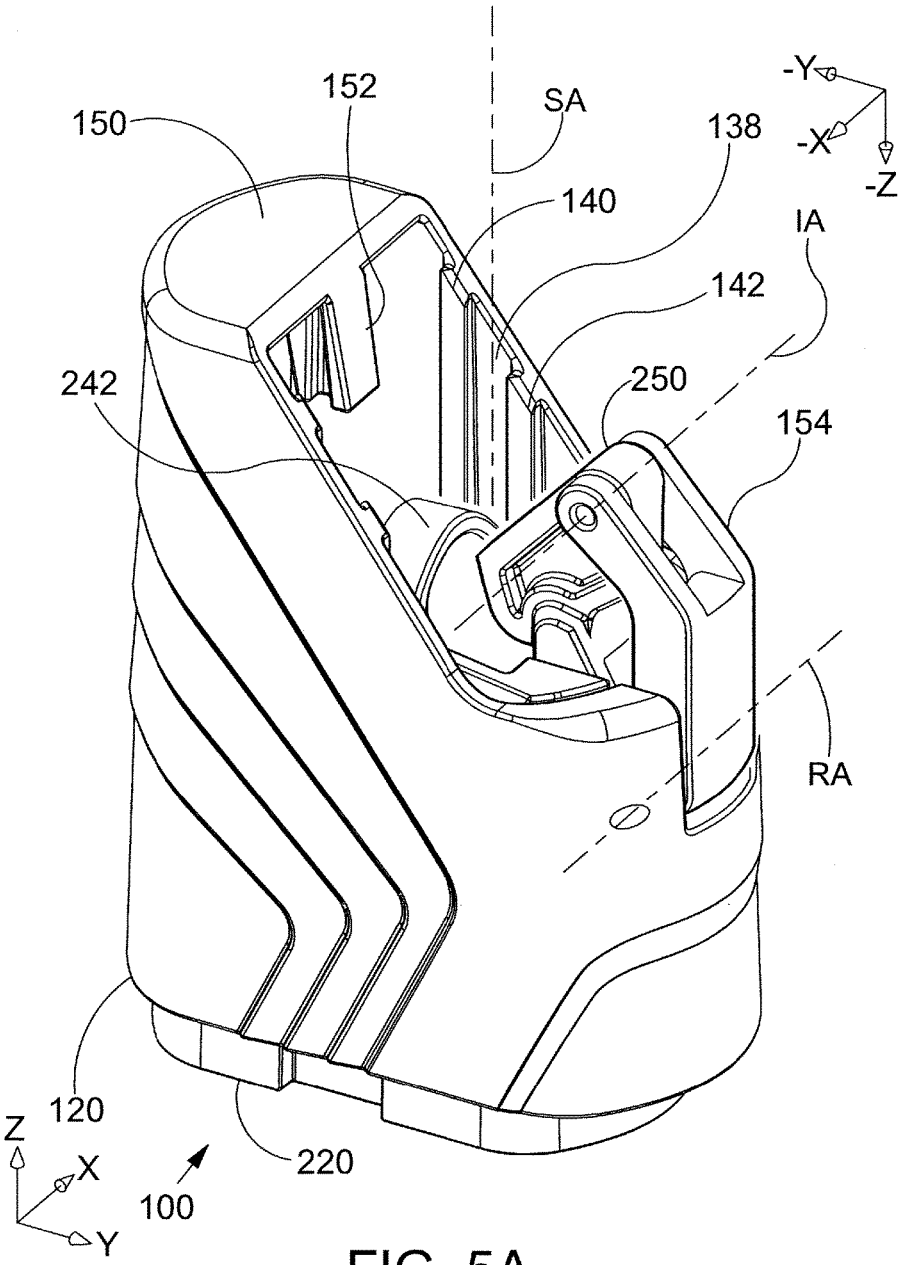
FIG. 5A is an enlarged perspective view of the magazine loader shown in FIG. 4A.
Figure 5B:
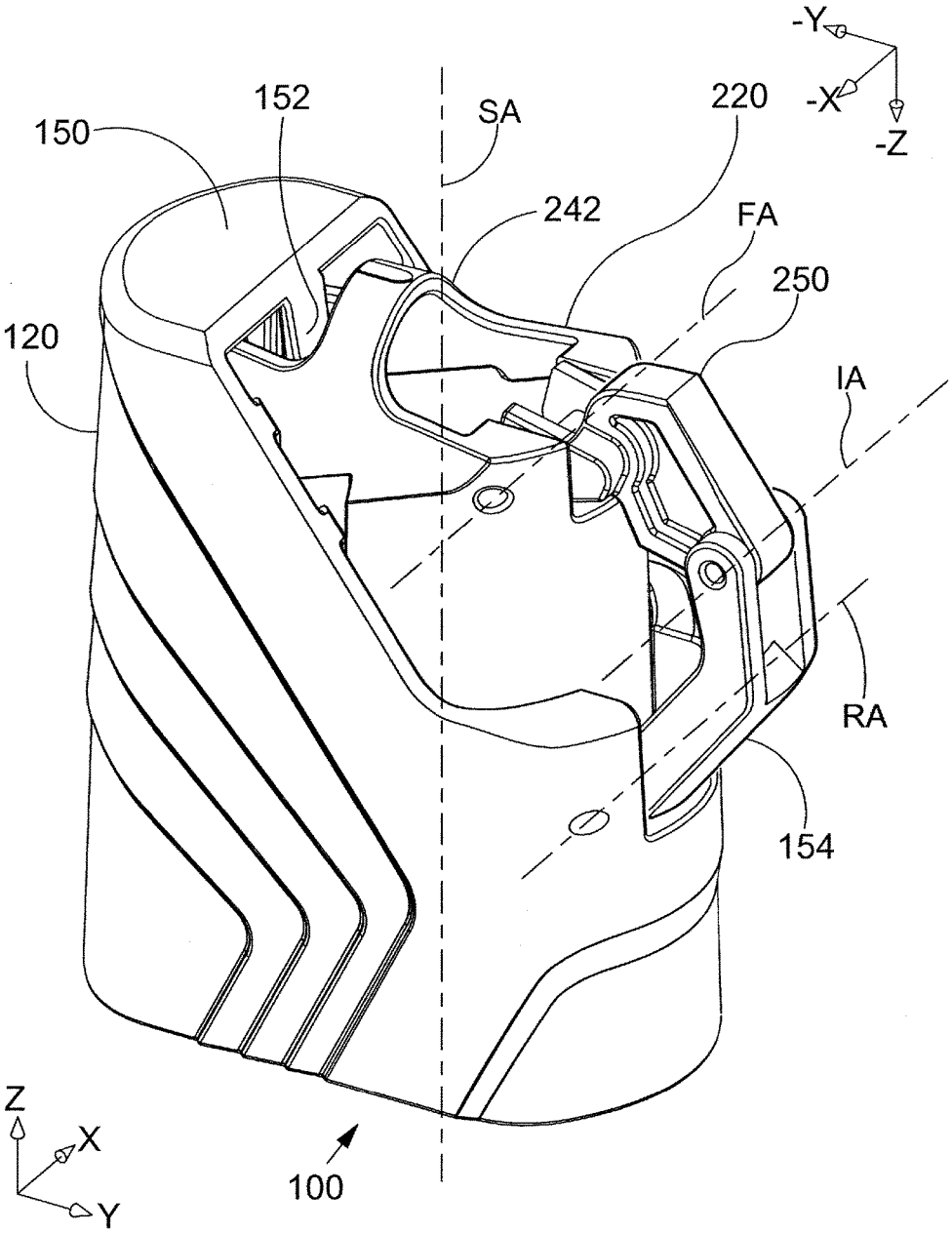
FIG. 5B is an enlarged perspective view of the magazine loader shown in FIG. 4B.
Figure 6B:
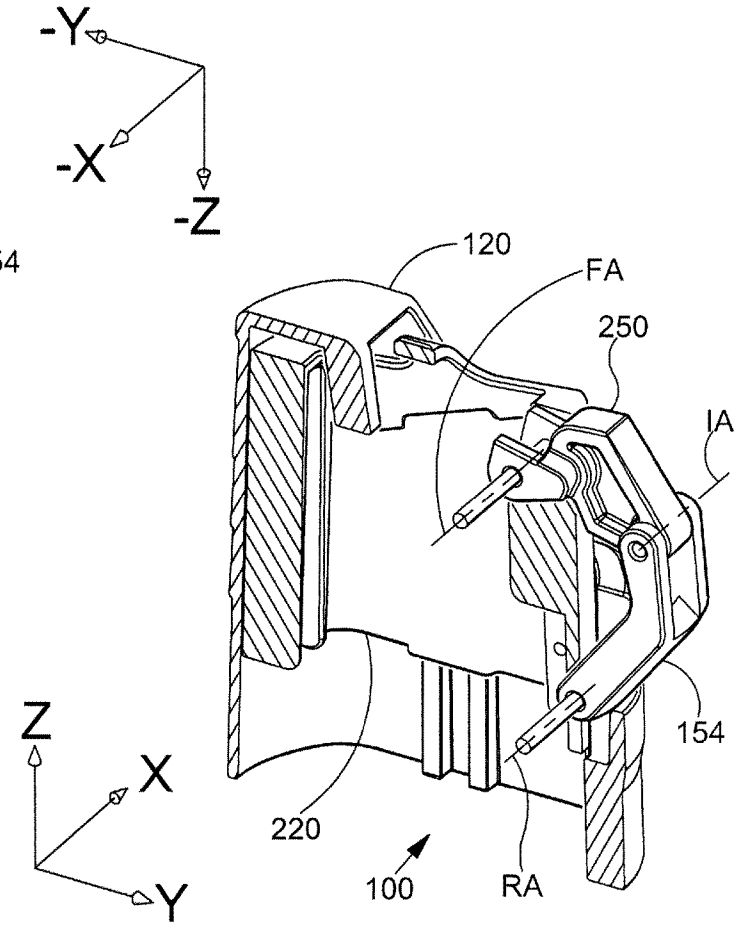
FIG. 6A and FIG. 6B are partial cross-sectional views of a magazine loader in accordance with the present invention. The magazine loader is in a cartridge receiving state in FIG. 6B and the magazine loader is in a cartridge seating state in FIG. 6A.
Figure 6A:
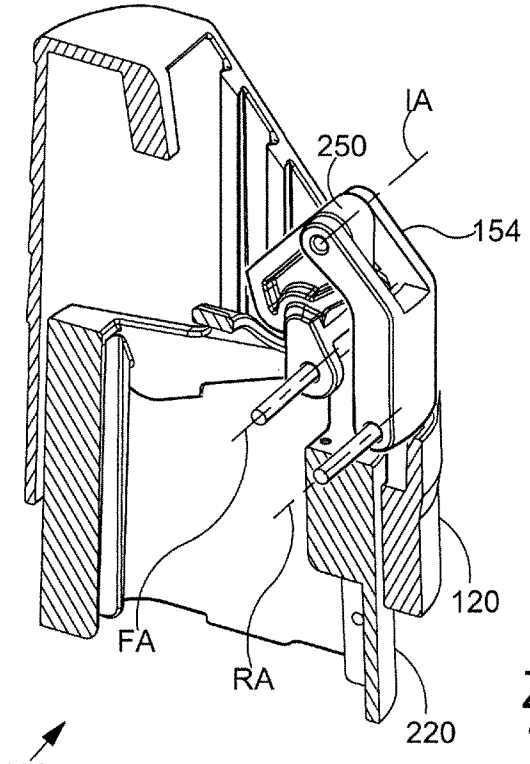
Figure 7A:
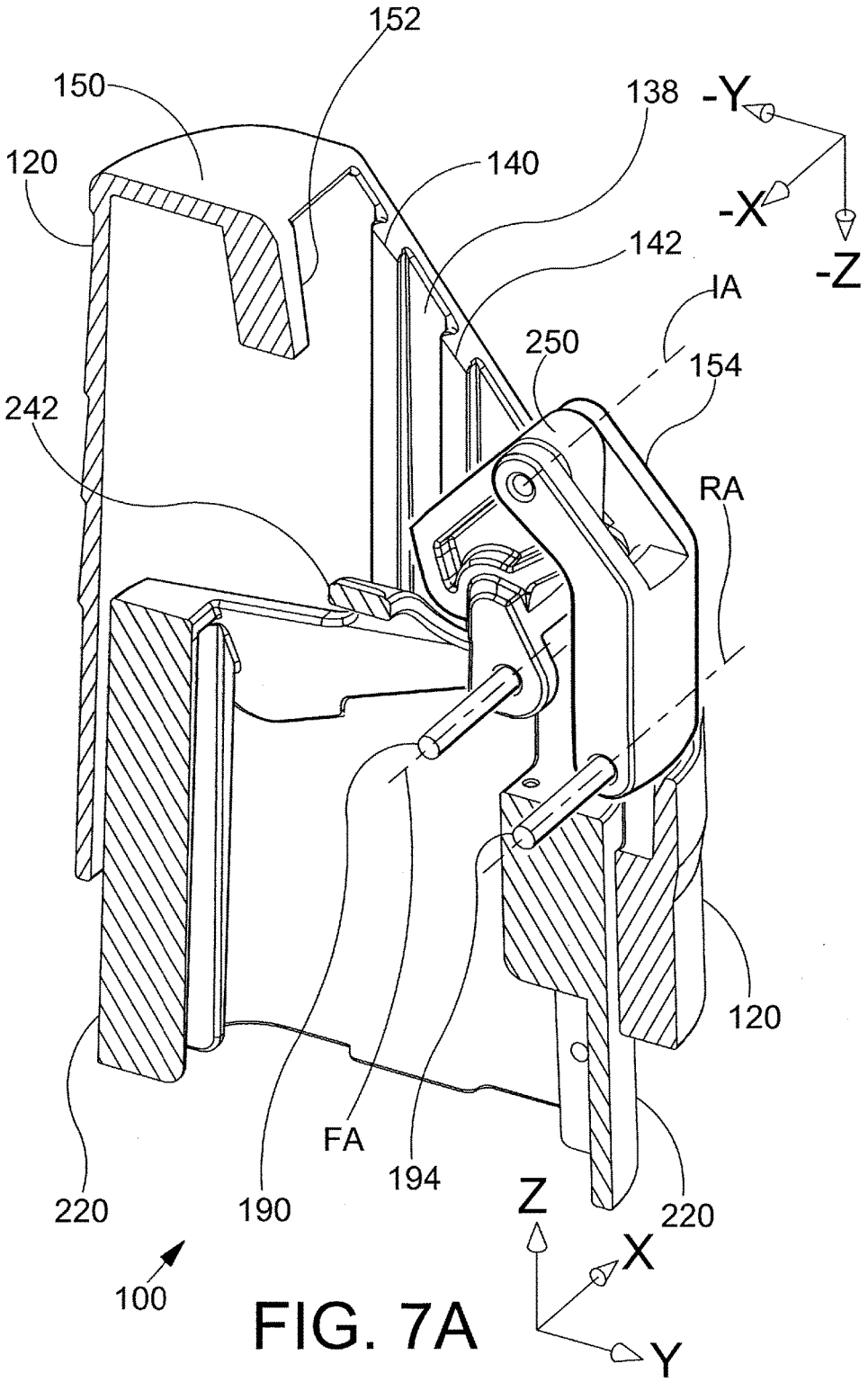
FIG. 7A is an enlarged partial cross-sectional view of the magazine loader shown in FIG. 6A.
Figure 7B:
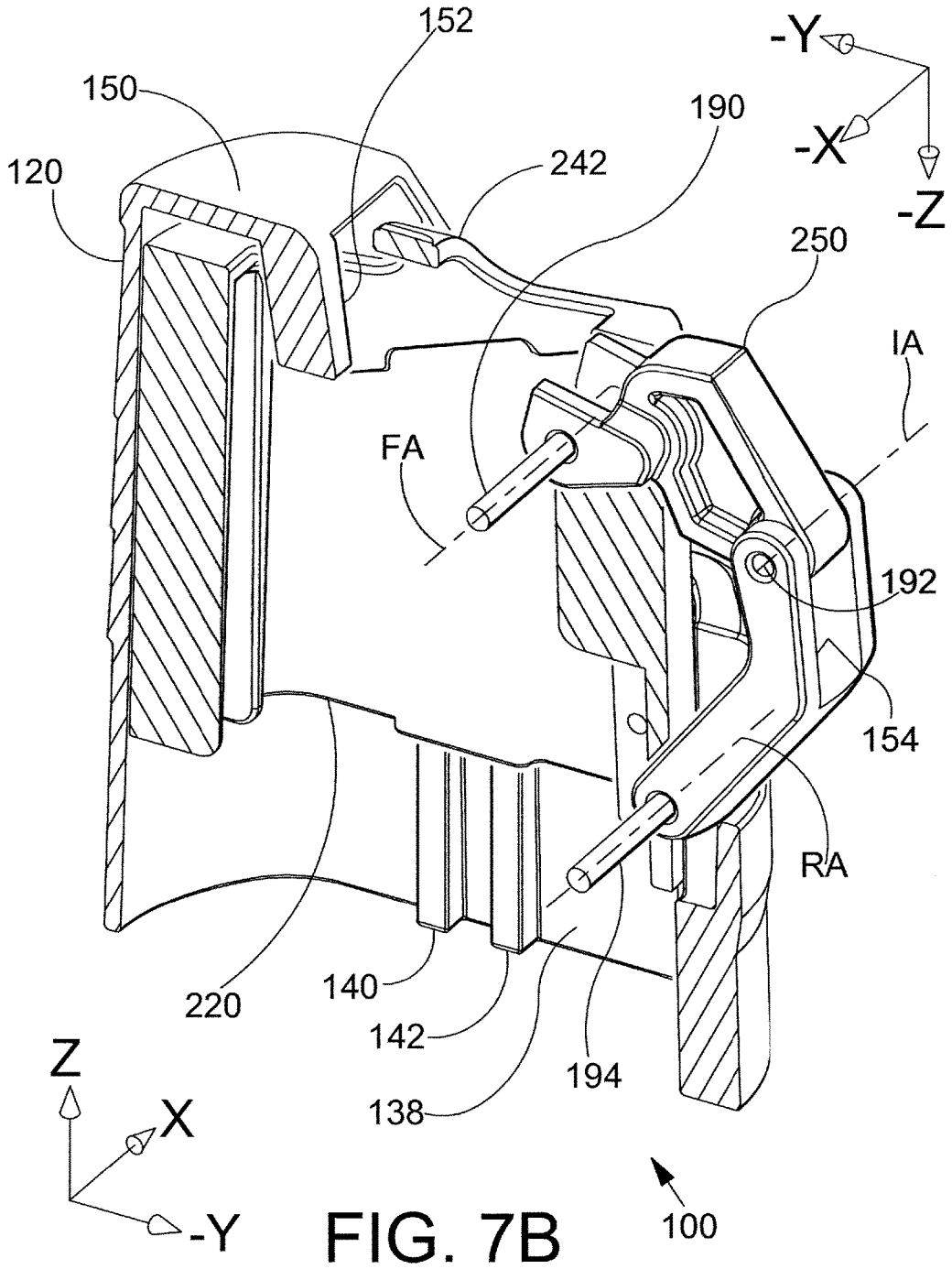
FIG. 7B is an enlarged partial cross-sectional view of the magazine loader shown in FIG. 6B.

FIG. 1 is a perspective view showing a handgun 22 and a magazine 20 containing a stack of cartridges 24. The stack of cartridges 24 may be placed into the handgun 22 by inserted the magazine 20 into a cavity in the handle portion of the handgun 22. FIG. 2A is a perspective view showing a stack 28 of cartridges 24 including an uppermost cartridge 26. FIG. 2B is a perspective view of a magazine 20 holding a stack of cartridges including an uppermost cartridge 26. The magazine 20 includes a first lip 30 and a second lip 32. The first lip 30 and the second lip 32 define and upper opening 34 of the magazine 20. In the embodiment of FIG. 2A, the upper opening defined by the first lip 30 and the second lip 32 has a width that is smaller than the diameter of the uppermost cartridge 26 so that the first lip 30 and the second lip 32 prevent the uppermost cartridge 26 from exiting the magazine 20 in an upward direction Z. FIG. 3 is a perspective view showing a magazine loader 100 and a magazine 20. The magazine loader 100 includes a body 120 and a sleeve 220. In the embodiment of FIG. 3, an upper portion of the magazine 20 is extending into a cavity defined by the sleeve 220 of the magazine loader 100. The magazine loader 100 may be used to load a plurality of cartridges 24 into the magazine.

Referring, for example, to FIGS. 4-8 and 21-24, a magazine loader 100 in accordance with some embodiments comprises setting mechanism 102 including a sleeve 220, a body 120, a setting tool 250 and a link 154. The sleeve 220 may comprise a plurality of sleeve wall portions defining a sleeve cavity 230. In some useful embodiments, the sleeve cavity 230 is configured to receive an upper portion of the magazine and the sleeve cavity 230 extends along a magazine insertion and withdrawal axis MA. In some embodiments, the body 120 is slidingly disposed about the sleeve 220 so that the body 120 and the sleeve 220 can slide relative to one another along a sliding axis SA, the sliding axis SA extending in upward and downward directions. The body 120 may translate between an upper position and a lower position along the sliding axis SA in some embodiments. In some embodiments, the body 120 comprises a plurality of body wall portions and the plurality of body wall portions define an interior volume 130 of the body 120. A first end of the setting tool 250 may be pivotally coupled to the sleeve 220 for rotation of the setting tool 250 with respect to the sleeve 220 about a first axis FA. A second end of the setting tool 250 may be pivotally coupled to a first end of the link 154 for relative rotation between the setting tool 250 and the link 154 about a second axis IA. A second end of the link 154 may be pivotally coupled to the body 120 for rotation of the link 154 with respect to the body 120 about a third axis RA. In some useful embodiments, when the body 120 translates upwardly with respect to the sleeve 220, the setting tool 250 rotates about the first axis FA and a cartridge engagement portion of the setting tool 250 swings inwardly in a cartridge insertion motion as the body 120 translates between the lower position and the upper position.

Referring, for example, to FIGS. 2-8, a method for loading cartridges into a magazine may include providing an apparatus, the apparatus comprising a sleeve defining a sleeve cavity configured to receive an upper portion of the magazine, a body slidingly disposed about the sleeve, and a setting tool having a first end pivotally coupled to the sleeve for rotation about a first axis. An upper portion of the magazine may be inserted into the sleeve cavity. The body may be urged to translate downwardly whereby the setting tool rotates about the first axis and a cartridge engaging portion of the setting tool swings outwardly as the body translates downwardly. One end of a cartridge may be insert through an opening defined by the body. The body may be allowed to translate upwardly, wherein the setting tool rotates about the first axis and the cartridge engagement portion of the setting tool swings inwardly in a cartridge insertion motion as the body translates upwardly.

Referring, for example, to FIGS. 4-10 and 21-24, a magazine loader 100 for loading cartridges into a magazine may comprise a body 120 including a starboard body wall portion 126, a port body wall portion 128, and a front body wall portion 122 disposed opposite a rear body wall portion 124. The starboard body wall portion 126 may extend between the rear body wall portion 124 and the front body wall portion 122. The port body wall portion 128 may extend opposite the starboard body wall portion 126 between the rear body wall portion 124 and the front body wall portion 122. The body wall portions may cooperate to define an interior volume 130 of the body 120. In some embodiments, the body 120 also includes a panel 150 extending between an upper portion of the starboard body wall portion 126 and an upper portion of the port body wall portion 128. The panel 150 may carry a post 152 that is configured to apply downwardly directed forces to a stack of cartridges in the magazine.

The magazine loader 100 may also comprise a sleeve 220 that is at least partially disposed inside the interior volume 130 defined by the wall portions of the body 120. In some embodiments, the sleeve 220 comprises a front sleeve wall portion 222 disposed opposite a rear sleeve wall portion 224 and a starboard sleeve wall portion 226 disposed opposite a port sleeve wall portion 228. The starboard sleeve wall portion 226 may extend between the rear sleeve wall portion 224 and the front sleeve wall portion 222. The port sleeve wall portion 228 may extend between the rear sleeve wall portion 224 and the front sleeve wall portion 222 opposite the starboard sleeve wall portion 226. The inner surfaces of the sleeve wall portions may cooperate to define a sleeve cavity 230 that is dimensioned and adapted to receive and upper portion of the magazine. In some embodiments, an outer surface of the starboard sleeve wall portion 226 defines a starboard channel 238 and an outer surface of the port sleeve wall portion 228 defines a port channel.

The starboard body wall portion 126 may comprise a starboard inner surface 138, a first starboard rib 140 projecting beyond the starboard inner surface 138 and a second starboard rib 142 projecting beyond the starboard inner surface 138. In some embodiments, the first starboard rib 140 and the second starboard rib 142 of the starboard body wall portion 126 extend into the starboard channel 238 defined by the starboard outer surface 244 of the starboard sleeve wall portion 226. The port body wall portion 128 may comprise a port inner surface 144, a first port rib 146 projecting beyond the port inner surface 144 and a second port rib 148 projecting beyond the port inner surface 144. In some embodiments, the first port rib 146 and the second port rib 148 of the port body wall portion 128 extend into the port channel 240 defined by the port outer surface 246 of the port sleeve wall portion 228.

In some embodiments, the sleeve 220 further comprises a bridge 242 extending between an upper portion of the starboard sleeve wall portion 226 and an upper portion of the port sleeve wall portion 228. The front sleeve wall portion 222 may define a sleeve notch 232. The front sleeve wall portion 222 may also define a first lumen 234 disposed on a first side of the sleeve notch and a second lumen 236 disposed on a second side of the sleeve notch 232.

A setting tool 250 of the magazine loader 100 may be pivotally coupled to the front sleeve wall portion 222 at a shaft 190. In some embodiments, the setting tool 250 defines a first hole 250 and a second hole 254. The setting tool may be positioned so that the first hole 250 is inside the sleeve notch 232 defined by the front sleeve wall portion 222. A shaft 190 may extend through the first lumen 234 defined by the front sleeve wall portion 222, through the first hole 250 defined by the setting tool 250 and through the second lumen 236 defined by the front sleeve wall portion 222.

In some embodiments, the magazine loader 100 also includes a spring 300 comprising a length of wire 320. The wire 320 of the spring 300 may form a first arm 322, a second arm 324 and a first coil 326 disposed between the first arm 322 and the second arm 324. In some embodiments, the first coil 326 defines a first lumen 328. The first coil 326 may be disposed about the shaft 190 with the shaft 190 extending through the first lumen 328 defined by the first coil 326.

The front body wall portion 122 may define a cut-out 132, a first bore 134 disposed on a first side of the cut-out 132 and a second bore 136 disposed on a second side of the cut-out 132. In some embodiments, a link 154 of the magazine loader 100 is pivotally coupled to the setting tool 250 at a pin 192 proximate a first end of the link 154. The link 154 may be pivotally coupled to the front body wall portion 122 proximate a second end of the link 154. In some embodiments, the link 154 defines a first aperture 156. The link 154 may be positioned so that the first aperture 156 is inside the cut-out 132 defined by the front body wall portion 122. In some embodiments, a dowel 194 extends through the first bore 134 defined by the front body wall portion 122, the first aperture 156 defined by the link 154 and the second bore 136 defined by the front body wall portion 122.

Referring, for example, to FIGS. 10, 12A-12F and 24-26, the magazine loader 100 may include a lever 260 disposed inside the sleeve cavity 230 defined by the sleeve 220 for urging the magazine against the front wall portion of the sleeve 220. The lever 260 may be pivotally supported by an axle 196. In some embodiments, the axle 196 extends through a first puncture 264 defined by a starboard sleeve wall portion 226 of the sleeve 220 and a second puncture 266 defined by a port sleeve wall portion 228 of the sleeve 220. The spring 206 may comprise a length of wire 216. The wire 216 of the spring 206 may form a first leg 202, a second leg 204 and a coil 208 disposed between the first leg 202 and the second leg 204. The coil defines a lumen 210 in some embodiments. In some embodiments, the first leg 202 of the spring 206 is seated against the lever 260 and the second leg 204 of the spring 206 is seated against the sleeve 220. The axle 196 extends through the lumen 210 defined by the coil 208 disposed between the first leg 202 and the second leg 204 in some embodiments.

Figure 11C:
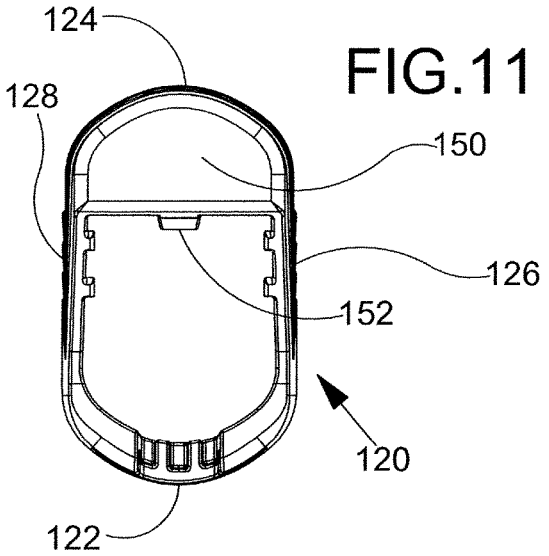
FIG. 11C is a top view of the magazine loader body shown in FIG. 11A.
Figure 11A:
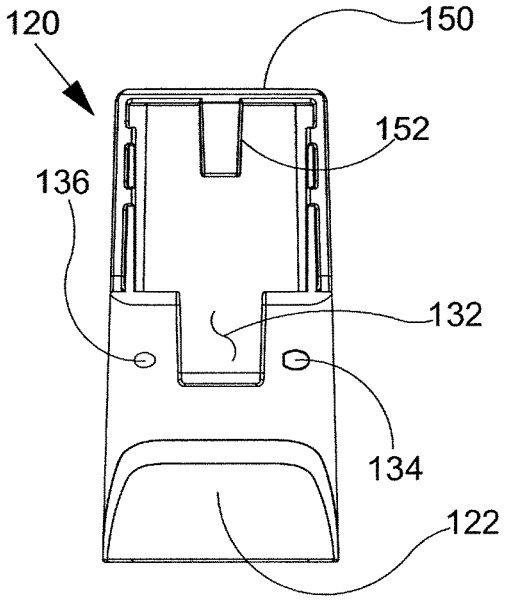
FIG. 11A is a front view of a magazine loader body.
Figure 11B:
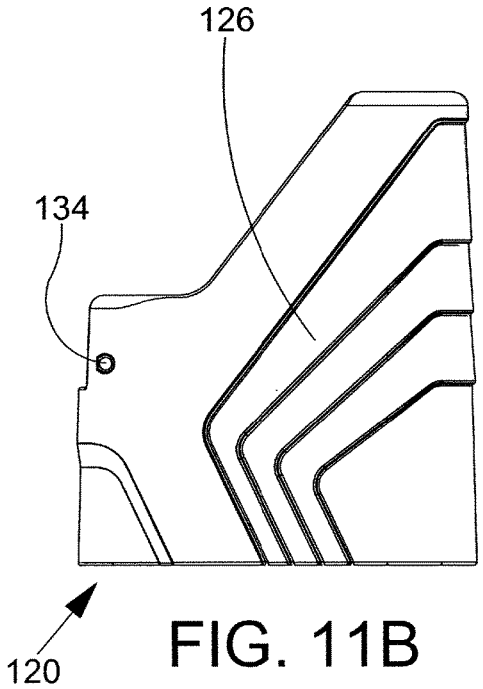
FIG. 11B is a right side view of the magazine loader body shown in FIG. 11A.

FIG. 11A through FIG. 11F are elevation and plan views showing six sides of the body 120. Engineer graphics textbooks generally refer to the process used to create views showing six sides of a three dimensional object as multiview projection or orthographic projection. It is customary to refer to multiview projections using terms such as front view, right side view, top view, rear view, left side view, and bottom view. In accordance with this convention, FIG. 11A may be referred to as a front view of the body 120, FIG. 11B may be referred to as a right side view of the body 120, and FIG. 11C may be referred to as a top view of the body 120. FIG. 11A through FIG. 11F may be referred to collectively as FIG. 11. Terms such as front view and right side view are used herein as a convenient method for differentiating between the views shown in FIG. 11. It will be appreciated that the elements shown in FIG. 11 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 11D may be referred to as a rear view of the body 120, FIG. 11E may be referred to as a left side view of the body 120, and FIG. 11F may be referred to as a bottom view of the body 120.

FIG. 12A through FIG. 12F are elevation and plan views showing six sides of the sleeve 220. FIG. 12A may be referred to as a front view of the sleeve 220, FIG. 12B may be referred to as a right side view of the sleeve 220, and FIG. 12C may be referred to as a top view of the sleeve 220. FIG. 12A through FIG. 12F may be referred to collectively as FIG. 12. Terms such as front view and right side view are used herein as a convenient method for differentiating between the views shown in FIG. 12. It will be appreciated that the elements shown in FIG. 12 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 12D may be referred to as a rear view of the sleeve 220, FIG. 12E may be referred to as a left side view of the sleeve 220, and FIG. 12F may be referred to as a bottom view of the sleeve 220.

Figure 13C:
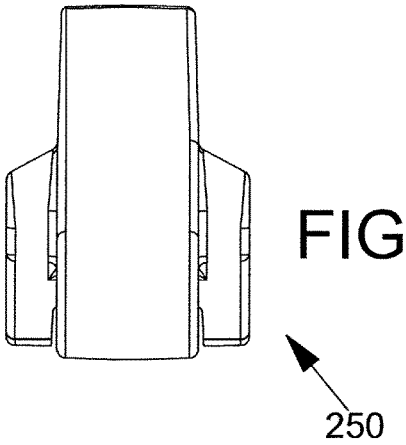
FIG. 13C is a top view of the setting tool shown in FIG. 13A.
Figure 13A:
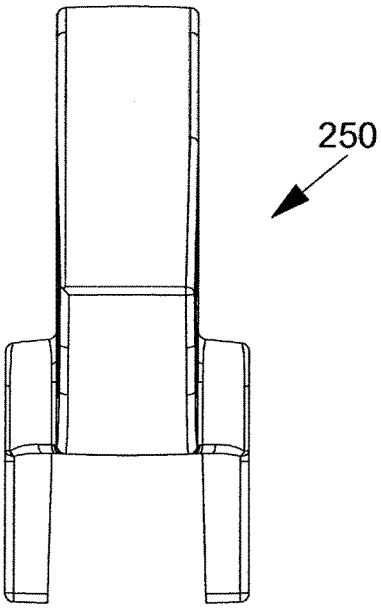
FIG. 13A is a front view of a setting tool for a magazine loader in accordance with the detailed description.
Figure 13B:
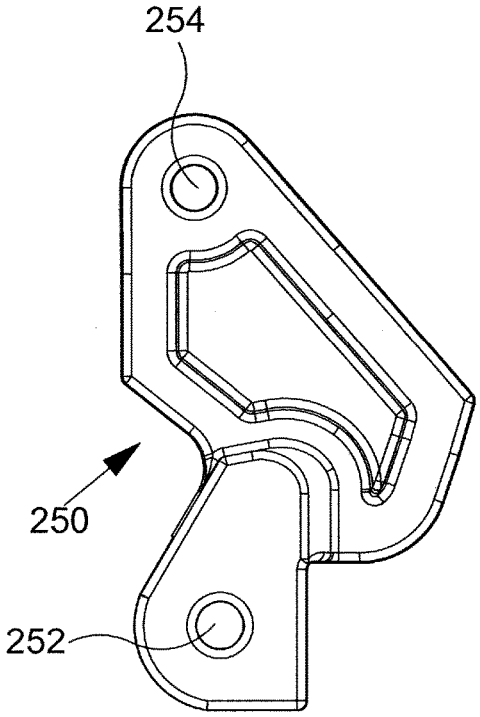
FIG. 13B is a right side view of the setting tool shown in FIG. 13A.
Figure 13D:
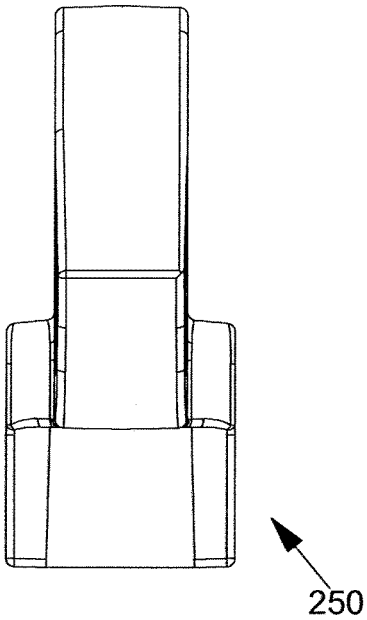
FIG. 13D is a rear view of the setting tool shown in FIG. 13A.
Figure 13E:
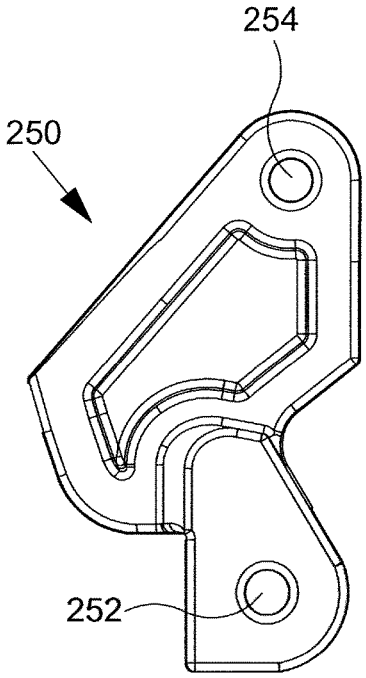
FIG. 13E is a left side view of the setting tool shown in FIG. 13A.
Figure 13F:
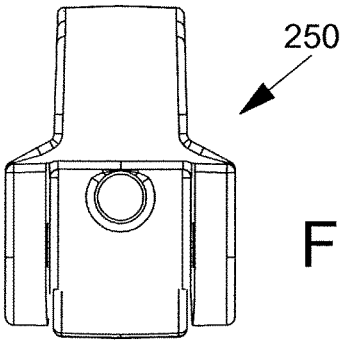
FIG. 13F is a bottom view of the setting tool shown in FIG. 13A.

FIG. 13A through FIG. 13F are elevation and plan views showing six sides of the setting tool 250. FIG. 13A may be referred to as a front view of the setting tool 250, FIG. 13B may be referred to as a right side view of the setting tool 250, and FIG. 13C may be referred to as a top view of the setting tool 250. FIG. 13D may be referred to as a rear view of the setting tool 250, FIG. 13E may be referred to as a left side view of the setting tool 250, and FIG. 13F may be referred to as a bottom view of the setting tool 250.

Figure 14C:
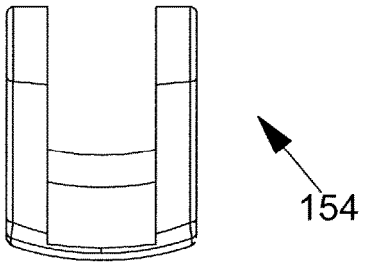
FIG. 14C is a top view of the link shown in FIG. 14A.
Figure 14A:
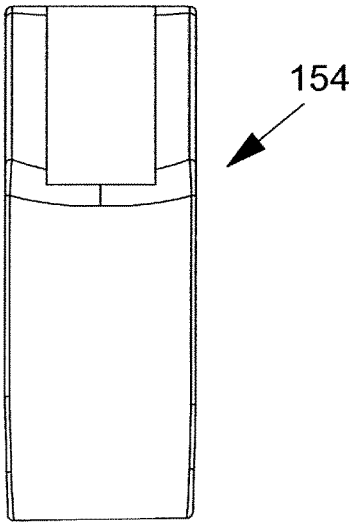
FIG. 14A is a front view of a link for a magazine loader in accordance with the detailed description.
Figure 14B:
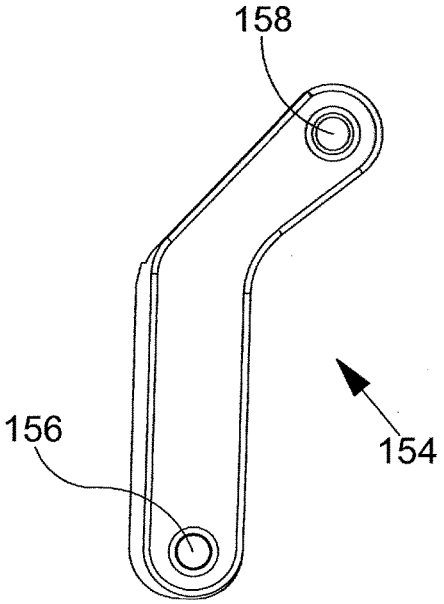
FIG. 14B is a right side view of the link shown in FIG. 14A.
Figure 14D:
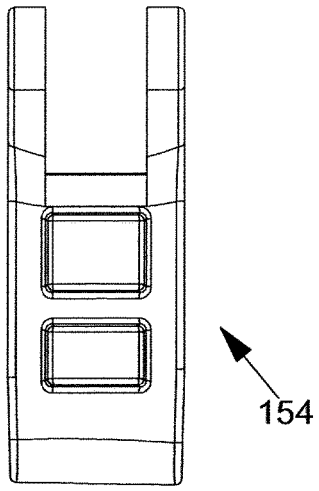
FIG. 14D is a rear view of the link shown in FIG. 14A.
Figure 14E:
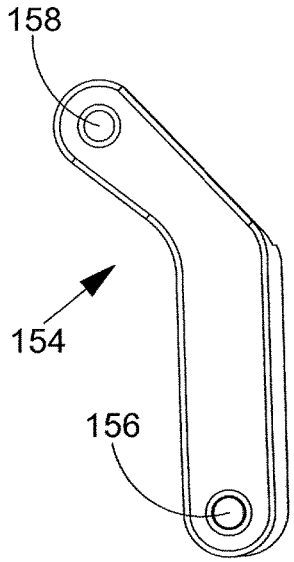
FIG. 14E is a left side view of the link shown in FIG. 14A.
Figure 14F:
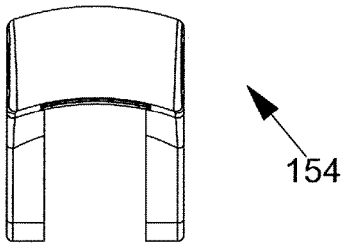
FIG. 14F is a bottom view of the link shown in FIG. 14A.

FIG. 14A through FIG. 14F are elevation and plan views showing six sides of the link 154. It is customary in the field of engineering graphics to refer to multiview projections using terms such as front view, right side view, top view, rear view, left side view, and bottom view. In accordance with this convention, FIG. 14A may be referred to as a front view of the link 154, FIG. 14B may be referred to as a right side view of the link 154, and FIG. 14C may be referred to as a top view of the link 154. FIG. 14A through FIG. 14F may be referred to collectively as FIG. 14. Terms such as front view and right side view are used herein as a convenient method for differentiating between the views shown in FIG. 14. It will be appreciated that the elements shown in FIG. 14 may assume various orientations without deviating from the spirit and scope of this detailed description. Accordingly, the terms front view, right side view, top view, rear view, left side view, bottom view, and the like should not be interpreted to limit the scope of the invention recited in the attached claims. FIG. 14D may be referred to as a rear view of the link 154, FIG. 14E may be referred to as a left side view of the link 154, and FIG. 14F may be referred to as a bottom view of the link 154.

Figure 10:
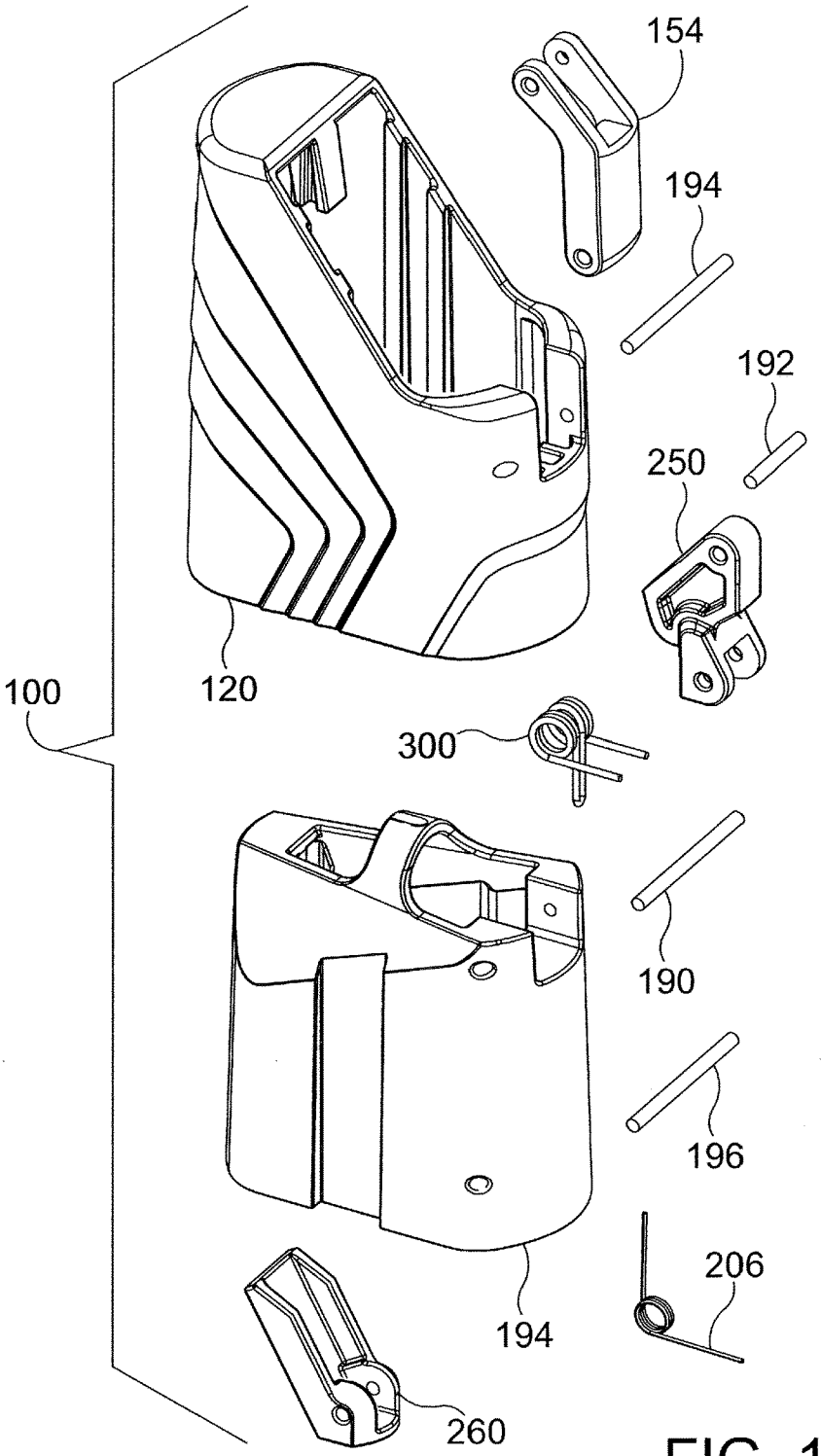
FIG. 10 is an exploded perspective view of a magazine loader in accordance with the detailed description.
Figure 15:
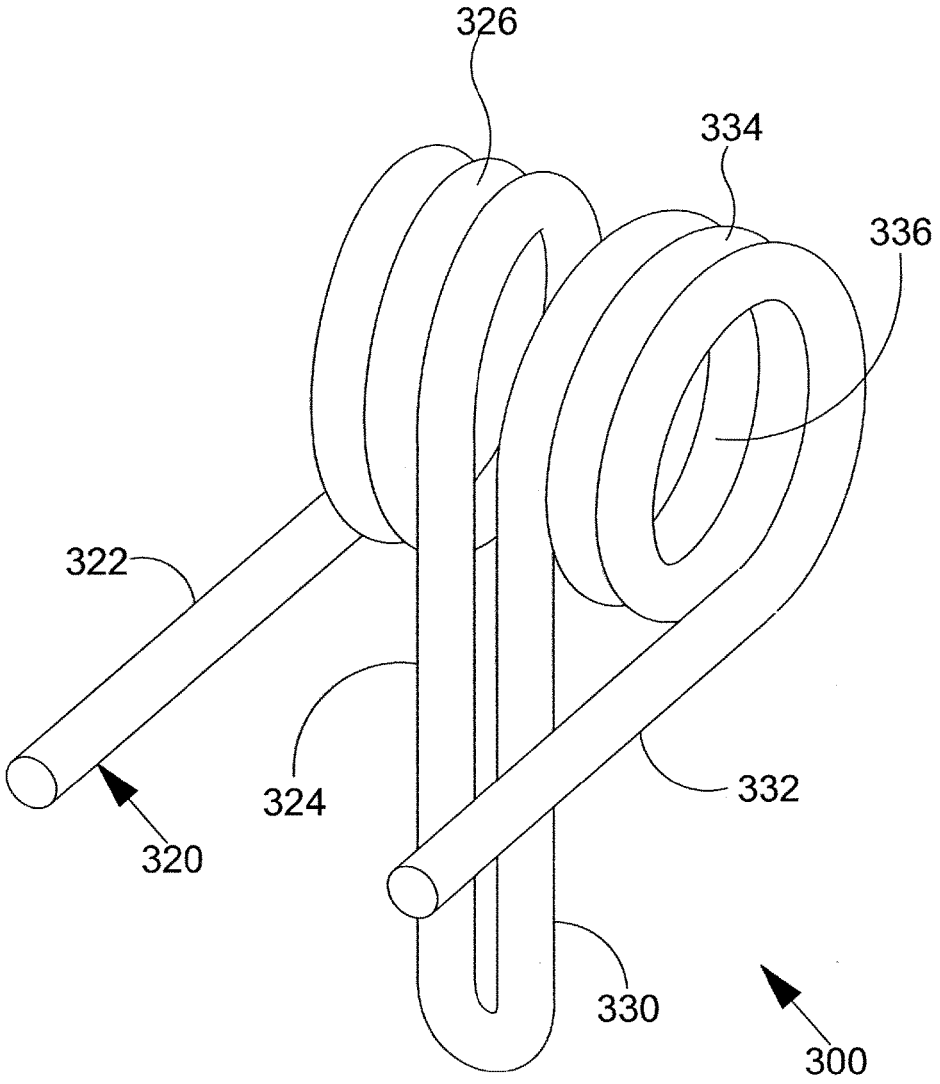
FIG. 15 is a perspective view of a spring for a magazine loader in accordance with the detailed description.
Figure 16:
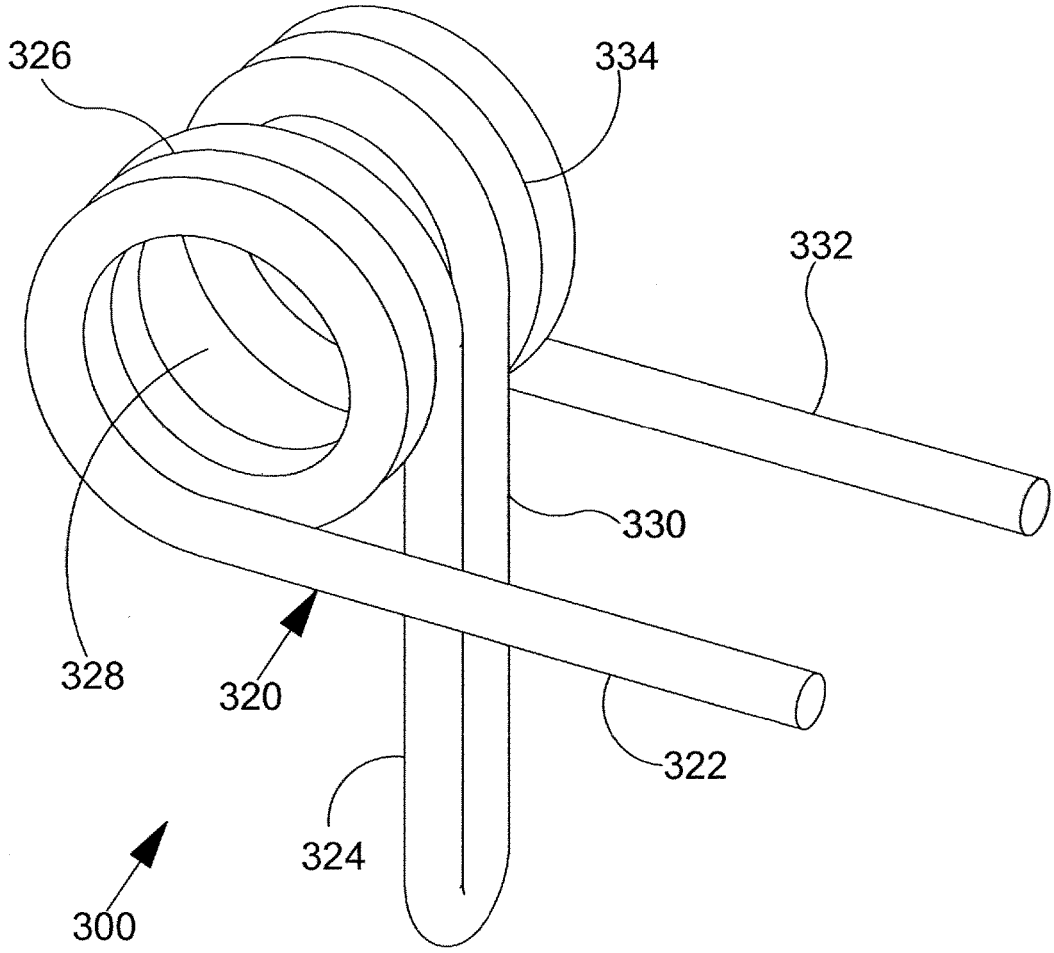
FIG. 16 is an additional perspective view of the spring shown in FIG. 15.
Figure 17:
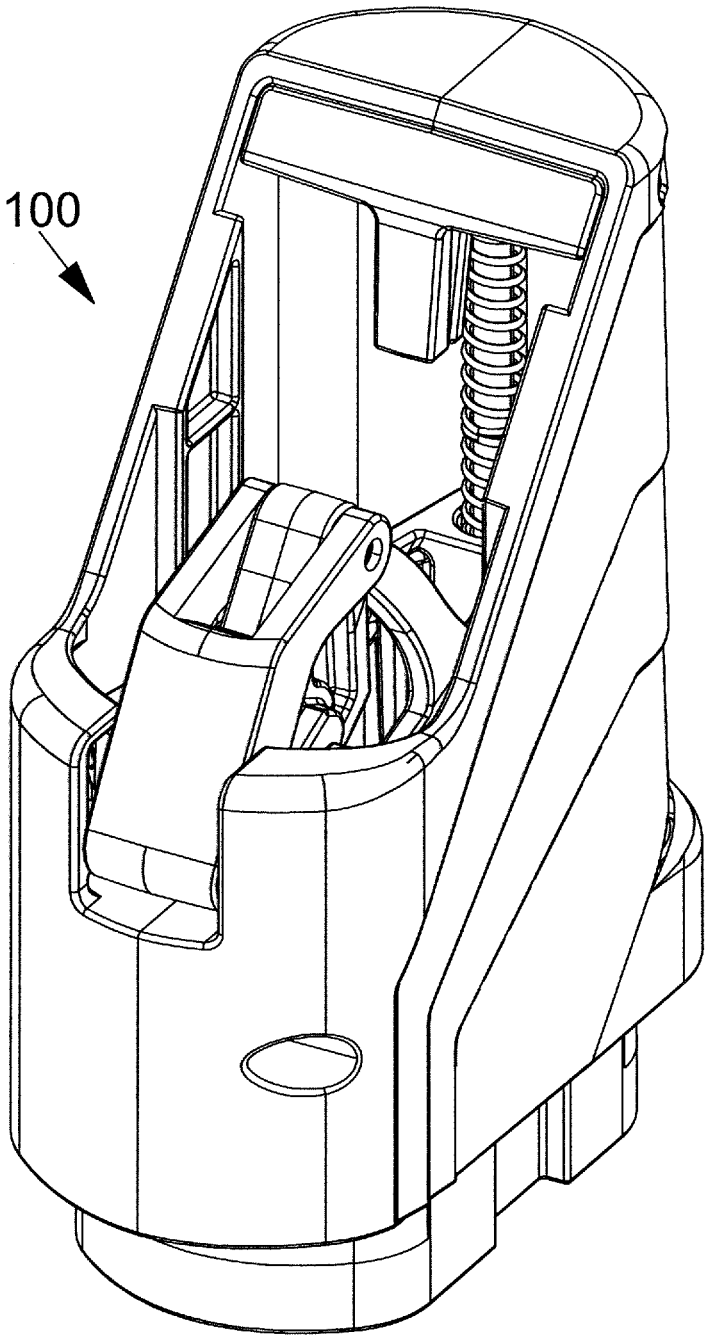
FIG. 17 is a front, right, top perspective view of a magazine loader.
Figure 18:
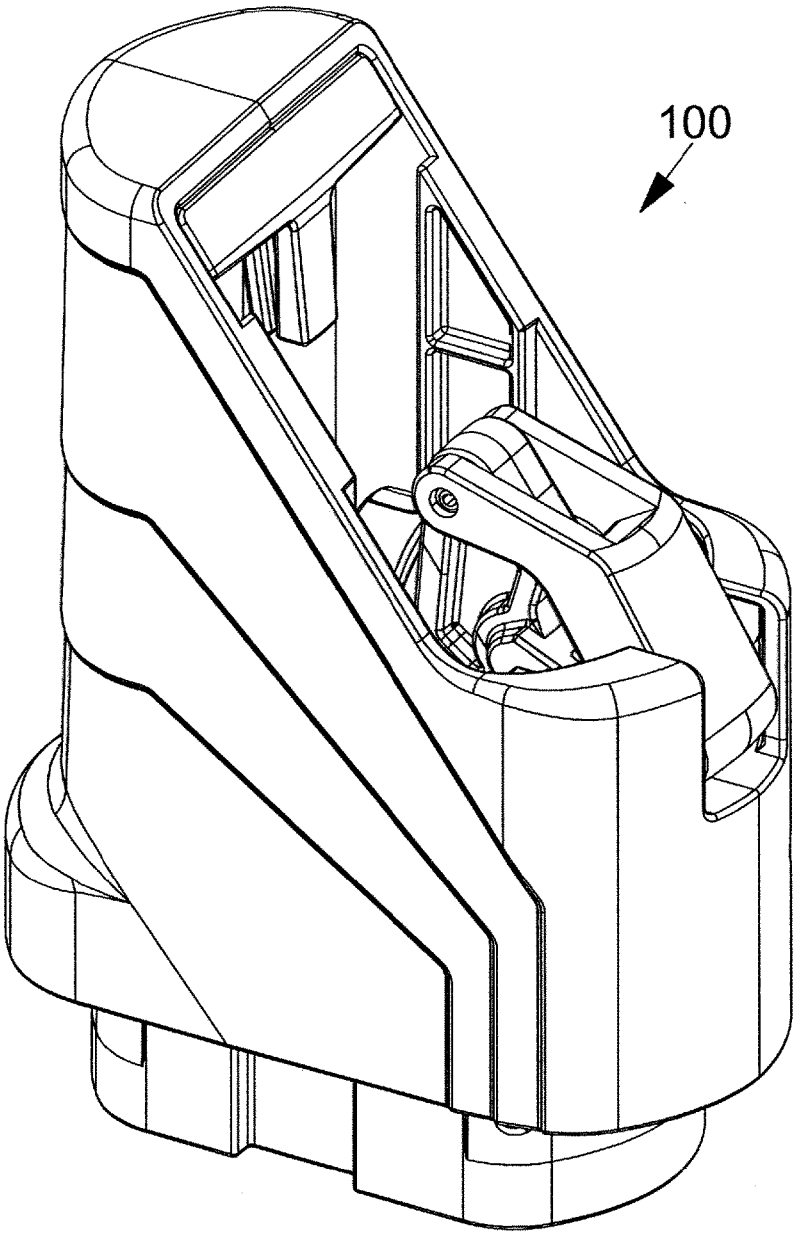
FIG. 18 is a front, left, top perspective view of a magazine loader.
Figure 19:
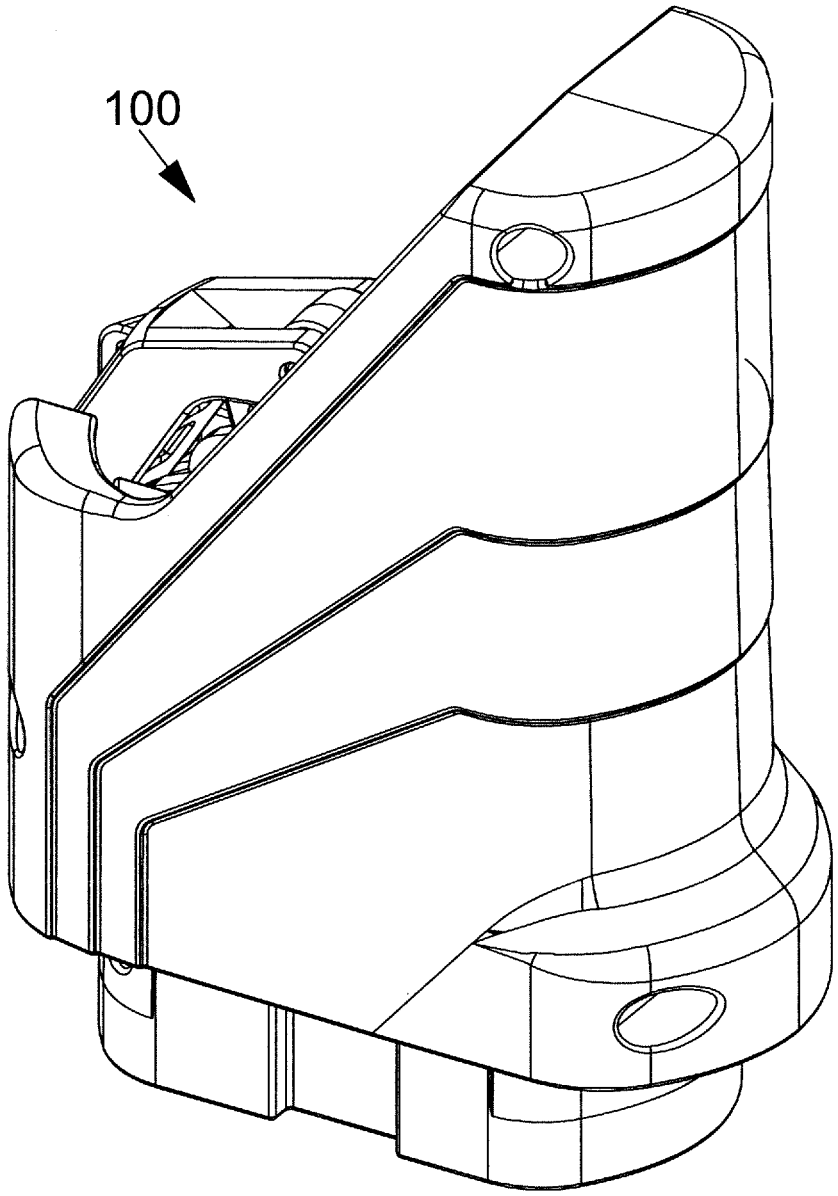
FIG. 19 is a rear, right, top perspective view of a magazine loader.
Figure 20:
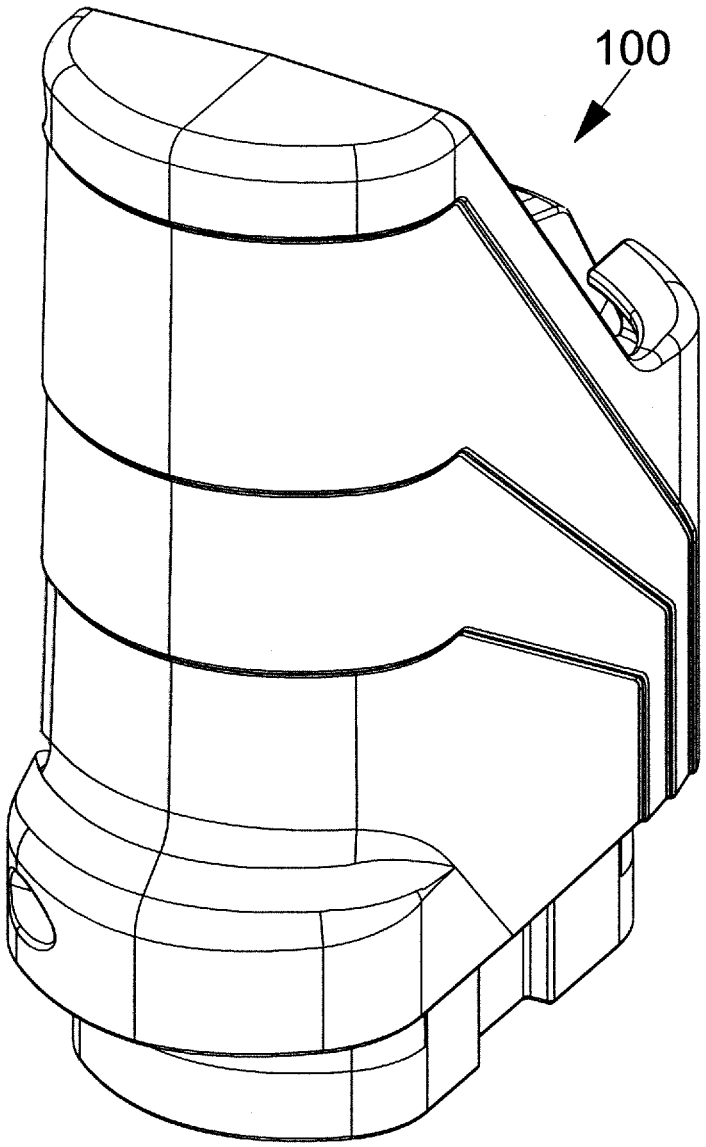
FIG. 20 is a rear, left, top perspective view of a magazine loader.

Referring to FIGS. 10, 15 and 16, a magazine loader 100, in accordance with some embodiments, comprises spring 300. The spring 300 comprising length of wire 320 forming a first arm 322, a second arm 324 and a first coil 326 disposed between the first arm 322 and the second arm 324. The first coil 326 defines a first lumen 328. When the magazine loader 100 is in an assembled state, the first coil 326 is disposed about the shaft 190 with the shaft 190 extending through the first lumen 328. In some embodiments, the spring 300 applies torque to the setting tool 250. In some embodiments, the spring biases the setting tool 250 toward a seated position. In the embodiment shown in FIGS. 15 and 16, the wire 320 forms a third arm 330, a fourth arm 332 and a second coil 334 disposed between the third arm 330 and the fourth arm 332. The second coil 334 defines a second lumen 336. When the magazine loader 100 is in an assembled state, the second coil 334 is disposed about the shaft 190 with the shaft 190 extending through the second lumen 336.

In some embodiments, the first coil 326 is wound in a first winding direction and the second coil 334 is wound in a second winding direction that is different from the first winding direction. In some embodiments, the second winding direction is opposite the first winding direction. In some embodiments, the first winding direction is a right handed winding direction and a second winding direction is a left handed winding direction. In some embodiments, the first winding direction is a left handed winding direction and a second winding direction is a right handed winding direction. In some embodiments, the first winding direction is a clockwise winding direction and a second winding direction is a counterclockwise winding direction. In some embodiments, the first winding direction is a counterclockwise winding direction and a second winding direction is a clockwise winding direction.

Referring, for example, to FIGS. 10, 12A-12F and 24-26, the magazine loader 100 may comprise a lever 260 that pivots about an axle 196 in some embodiments. In some embodiments, the lever 260 is biased to pivot toward a first position by a spring 206. When the magazine loader 100 is in an assembled state, the axle 196 extends through a first puncture 264 and a second puncture 266 defined by the sleeve 220 of the magazine loader 100.

Referring, for example, to FIGS. 4-8 and 21-24, a magazine loader 100 in accordance with some embodiments comprises a setting mechanism 102 including a sleeve 220, a body, a setting tool 250 and a link 154. The sleeve may comprise a plurality of sleeve wall portions defining a sleeve cavity 230. The sleeve cavity 230 may be configured to receive an upper portion of the magazine. In some embodiments, the sleeve cavity 230 extends along a magazine insertion and withdrawal axis MA. The body 120 may be slidingly disposed about the sleeve 220 so that the body 120 and the sleeve 220 slide relative to one another along a sliding axis SA. As shown, for example, in FIGS. 4-8, the sliding axis SA may extend in upward and downward directions. The body 120 may translate between an upper position and a lower position along the sliding axis SA. The body 120 may comprises a plurality of body wall portions. The body wall portions may define an interior volume of the body 120.

In some example embodiments, the setting mechanism 102 comprises the body 120, the sleeve 220, a setting tool 250 and a link 154. A first end of the link 154 may be pivotally coupled to a second end of the setting tool 250 for relative rotation between the setting tool and the link about an intermediate axis IA. A first end of the setting tool 250 may be pivotally coupled to the sleeve 220 for relative rotation between the setting tool 250 and the sleeve 220 about a forward axis FA. A second end of the link 154 may be pivotally coupled to the body 120 for relative rotation between the link 154 and the body 120 about a rearward axis RA. In some useful embodiments, the setting tool 250 rotates about the forward axis FA as the body 120 translates between the upper position and the lower position along the sliding axis SA.

Figure 21:
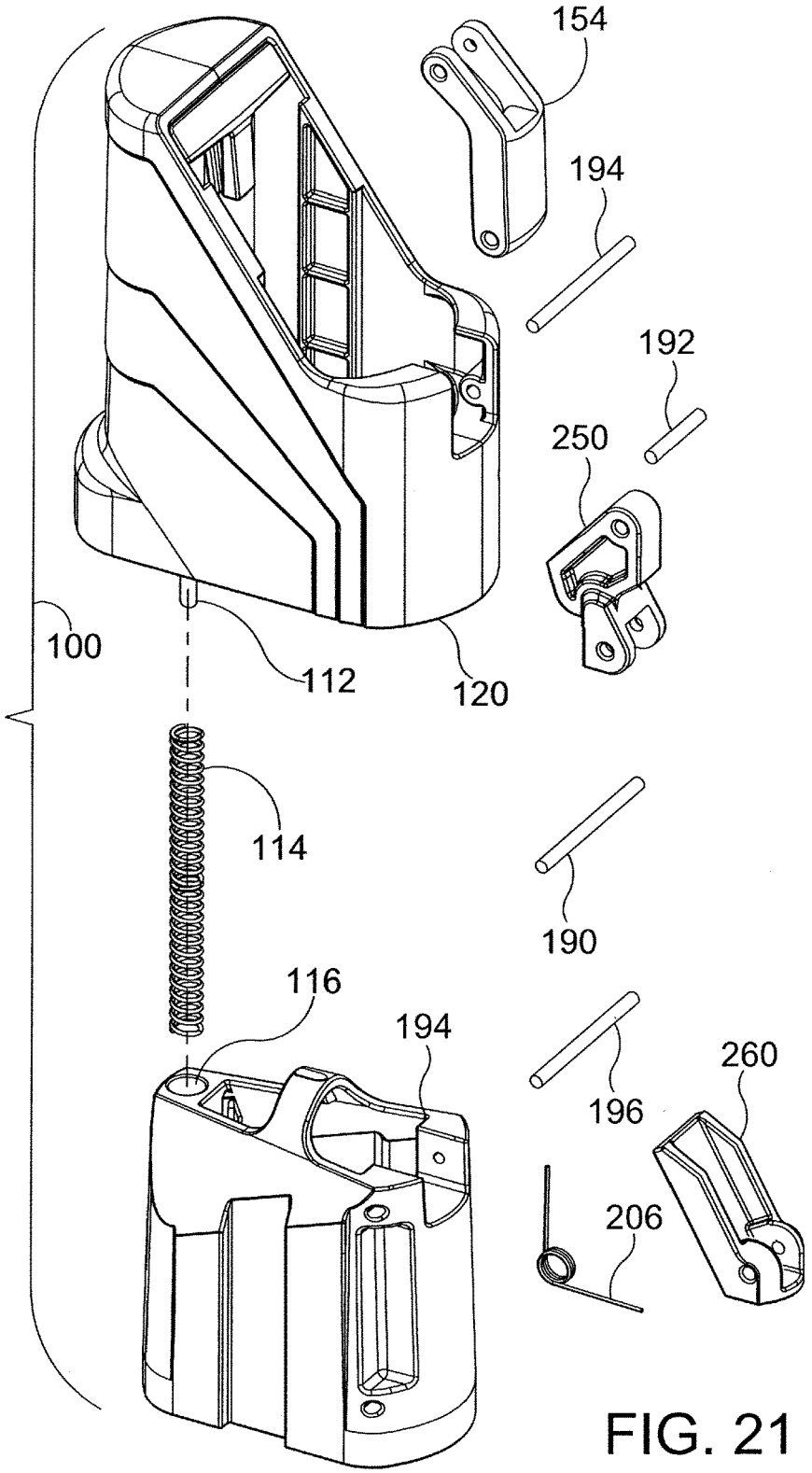
FIG. 21 is an exploded perspective view of a magazine loader in accordance with the detailed description.

Referring, for example, to FIG. 21, the magazine loader 100 may comprise a spring that urges the body 120 to translate toward the upper position along the sliding axis SA. In some embodiments, the magazine loader 100 includes a coil spring 114 having an upper end seated against the body 120 and a lower end seated against the sleeve 220. In some embodiments, the coil spring 114 of the magazine loader 100 is configured to urge the body 120 to translate toward the upper position along the sliding axis SA.

Figure 8C:
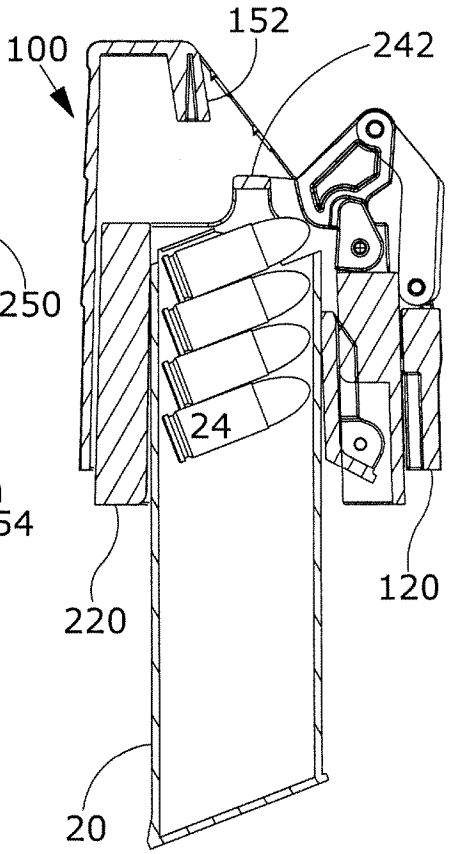
FIG. 8A, FIG. 8B and FIG. 8C are a sequence of stylized section views illustrating the operation of a magazine loader in accordance with the detailed description. In the embodiment of FIGS. 8A and 8B, the body of the magazine loader is disposed in a lowermost position. In the embodiment of FIG. 8C, the body of the magazine loader is disposed in an uppermost position.
Figure 8B:
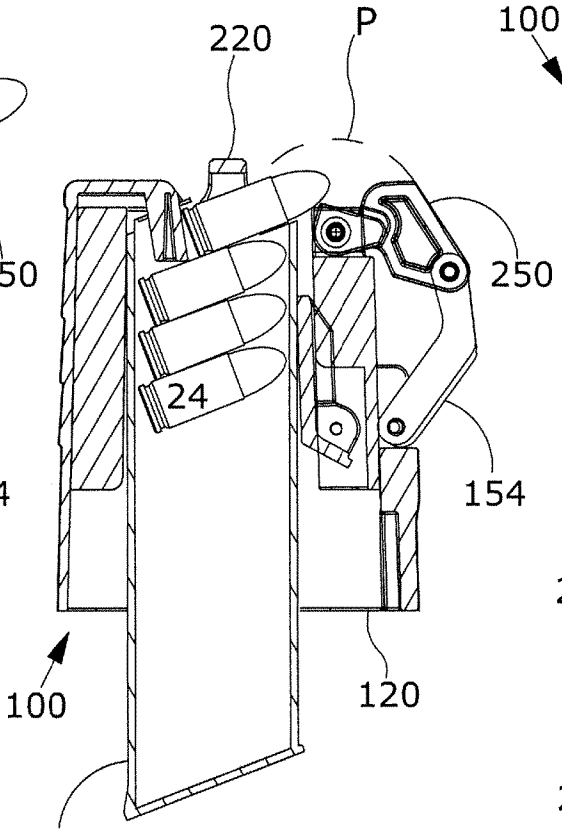
Figure 8A:
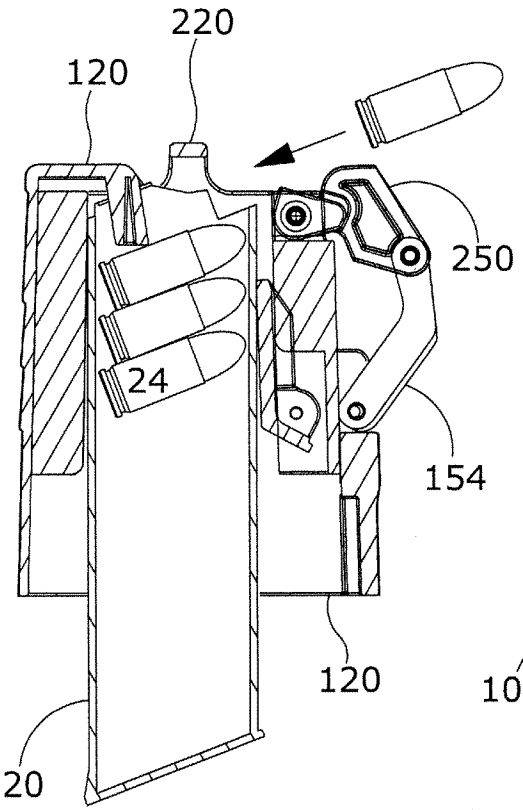
Figure 9A:
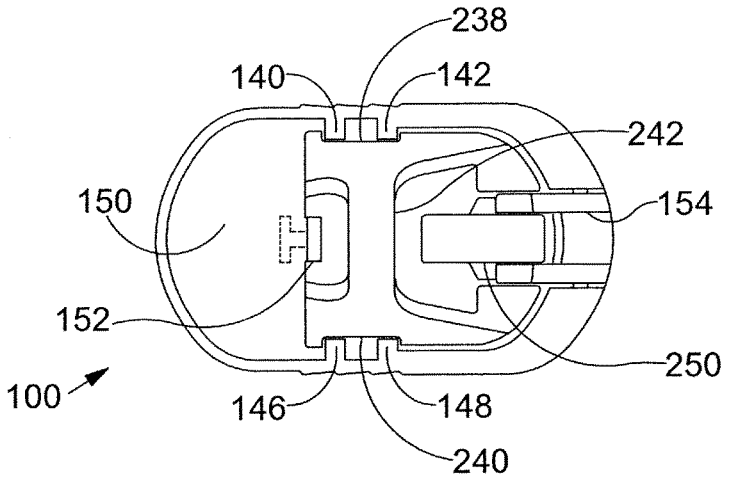
FIG. 9A is a top view of a magazine loader in accordance with the detailed description.
Figure 9B:
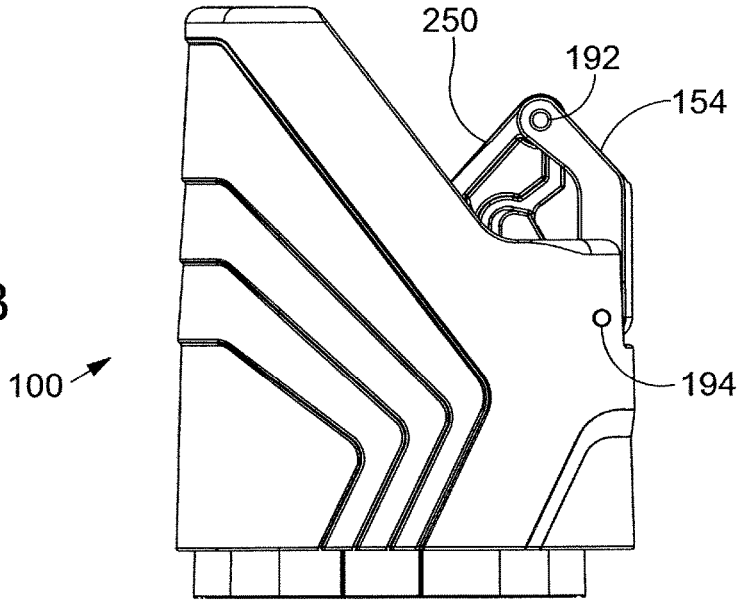
FIG. 9B is a left side view of the magazine loader body shown in FIG. 9A.
Figure 9C:
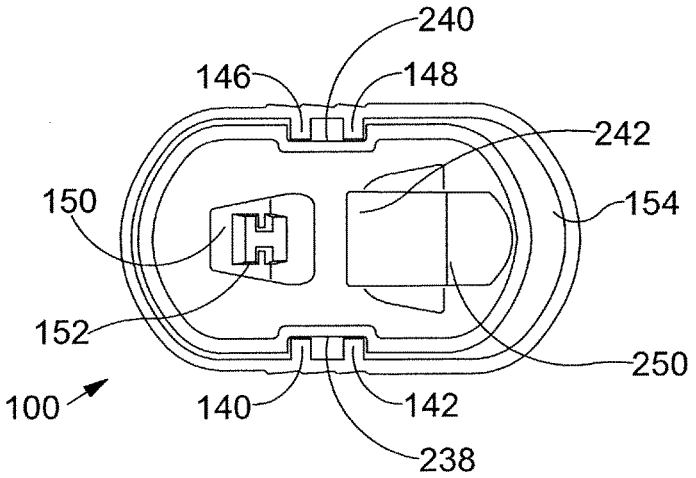
FIG. 9C is a bottom view of the magazine loader body shown in FIG. 9B.

Referring, for example, to FIG. 8, a point on the setting tool 250 may translate along an arc shaped path P as the setting tool 250 rotates. In some embodiments, the point on the setting tool 250 travels forward and upward as the point on the setting tool 250 translates along the arc shaped path P then travels forward and downward as the point on the setting tool 250 translates further along the arc shaped path P.

Referring, for example, to FIGS. 4-7 and 21-24, the body 120 of the magazine loader 100 may comprise a front body wall portion 122 disposed opposite a rear body wall portion 124 and a starboard body wall portion 126 that extends between the rear body wall portion 124 and the front body wall portion 122 proximate starboard ends thereof. A port body wall portion 128 of the body 120 may extend between the rear body wall portion 124 and the front body wall portion 122 proximate port ends thereof. The wall portions of the body 120 may define an interior volume 130 of the body 120. In some embodiments, the body 120 also includes a panel 150 extending between an upper portion of the starboard body wall portion 126 and an upper portion of the port body wall portion 128.

Referring, for example, to FIGS. 4-7, the sleeve 220 may comprise a front sleeve wall portion 222, a rear sleeve wall portion 224, a starboard sleeve wall portion 226, and a port sleeve wall portion 228. The front sleeve wall portion 222 is disposed opposite the rear sleeve wall portion 224 in some embodiments. The starboard sleeve wall portion 226 may extend between a starboard portion of the rear sleeve wall portion 224 and a starboard portion of the front sleeve wall portion 222. The port sleeve wall portion 228 may extend between a portward portion of the rear sleeve wall portion 224 and a portward portion of the front sleeve wall portion 222. The inner surfaces of the sleeve wall portions may define a sleeve cavity 230. In some useful embodiments, the sleeve cavity 230 is dimensioned and adapted to receive an upper portion of the magazine.

In some embodiments, the starboard sleeve wall portion 226 defines a starboard channel 238. The starboard body wall portion 126 comprises a starboard inner surface 138 and a starboard rib 140 projecting in a portward direction beyond the starboard inner surface 138 in some embodiments. The starboard rib 140 of the starboard body wall portion 126 extends into the starboard channel 238 defined by the port sleeve wall portion 228 in some embodiments.

In some embodiments, the port sleeve wall portion 228 defines a port channel 240. The port body wall portion 128 comprises a port inner surface 144 and a port rib 146 projecting in a starboard direction beyond the port inner surface 144 in some embodiments. The port rib 146 of the body 120 extends into the port channel 240 defined by the port sleeve wall portion 228 in some embodiments.

In some embodiments, the front sleeve wall portion 222 defines a sleeve notch 232, a first lumen 234 disposed on a first side of the sleeve notch 232 and a second lumen 236 disposed on a second side of the sleeve notch 232. The setting tool 250 may be positioned so that a first hole 252 defined by the setting tool 250 is inside the sleeve notch 232 defined by the front sleeve wall portion 222. A shaft 190 of the magazine loader 100 may extend through the first lumen 234 defined by the front sleeve wall portion 222, through the first hole 252 defined by the setting tool 250 and through the second lumen 236 defined by the front sleeve wall portion 222.

In some embodiments, the front body wall portion 122 defines a cut-out 132, a first bore 134 disposed on a first side of the cut-out 132 and a second bore 136 disposed on a second side of the cut-out 132. The link 154 may be positioned so that a first aperture 156 defined by the link 154 is inside the cut-out 132 defined by the front body wall portion 122. A dowel 104 of the magazine loader 100 may extend through the first bore 134 defined by the front body wall portion 122, the first aperture 156 defined by the link 154 and the second bore 136 defined by the front body wall portion 122. The first end of the link 154 may be pivotally coupled to the second end of the setting tool 250 at a pin 192. The pin 192 may extend through the link 154 and the setting tool 250.

Figure 22:
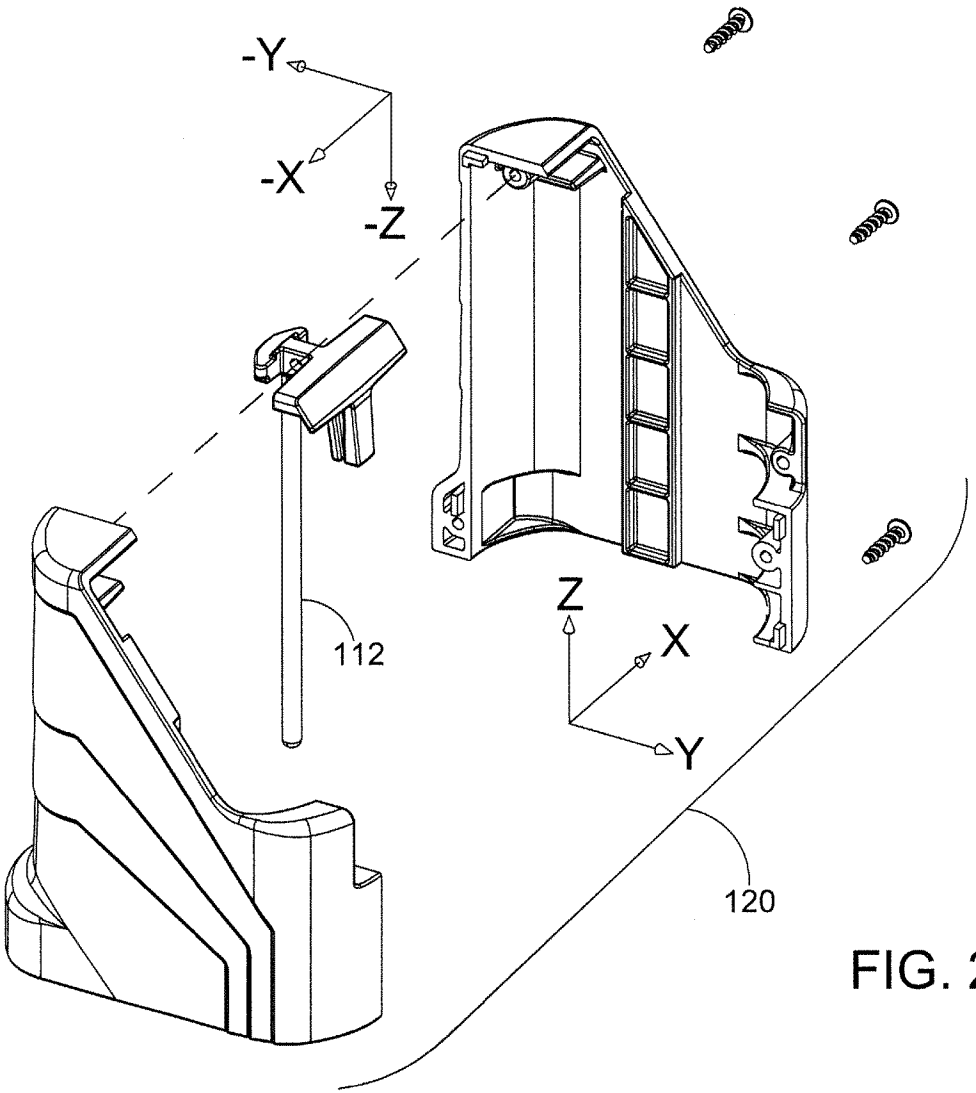
FIG. 22 is an exploded perspective view of a magazine loader body in accordance with the detailed description. In the embodiment of FIG. 22, the magazine loader body is formed from a first clamshell portion and a second clamshell portion that are held together with screws.
Figure 23:
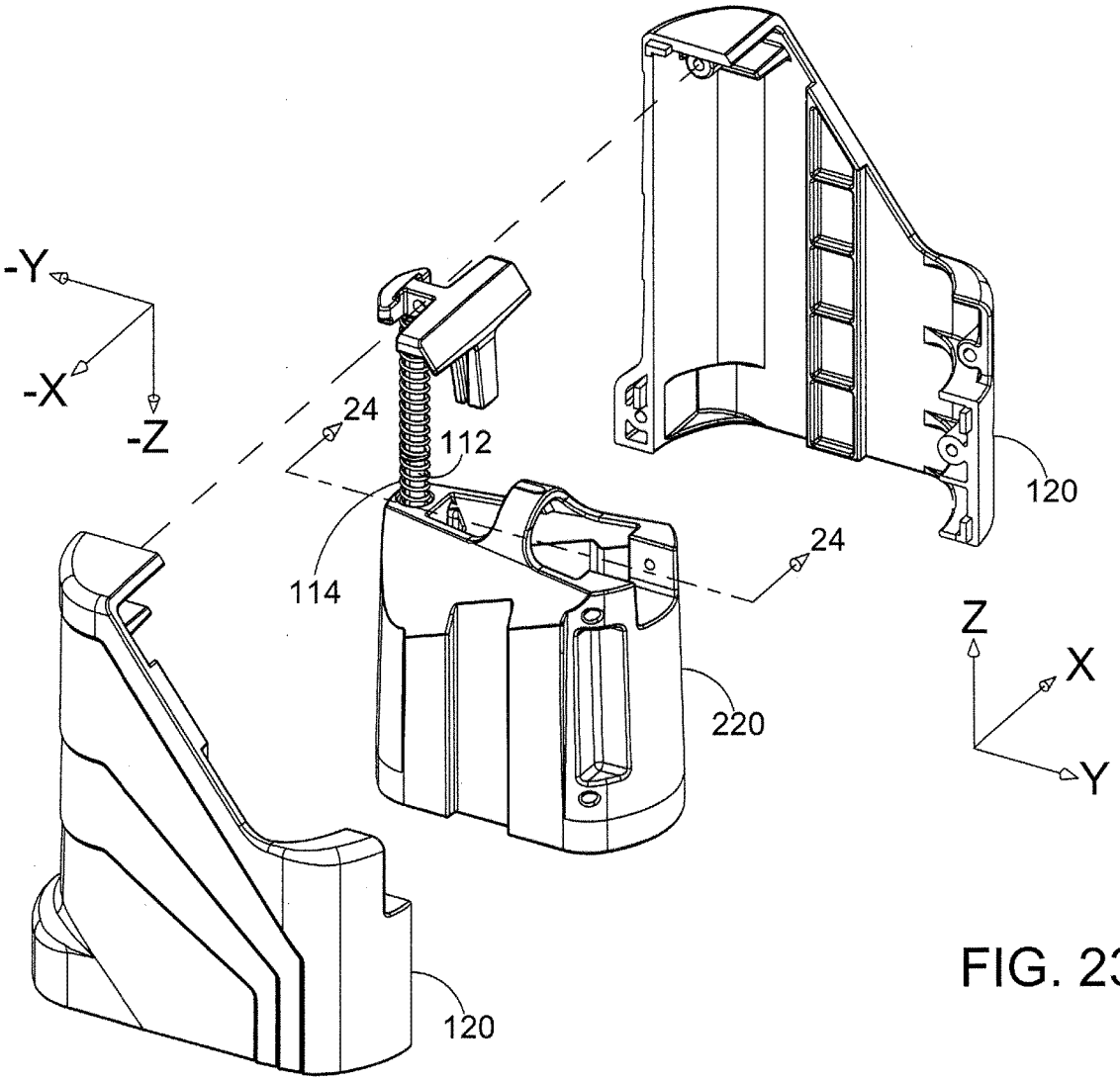
FIG. 23 is a partially exploded perspective view of a magazine loader in accordance with the detailed description.
Figure 24:
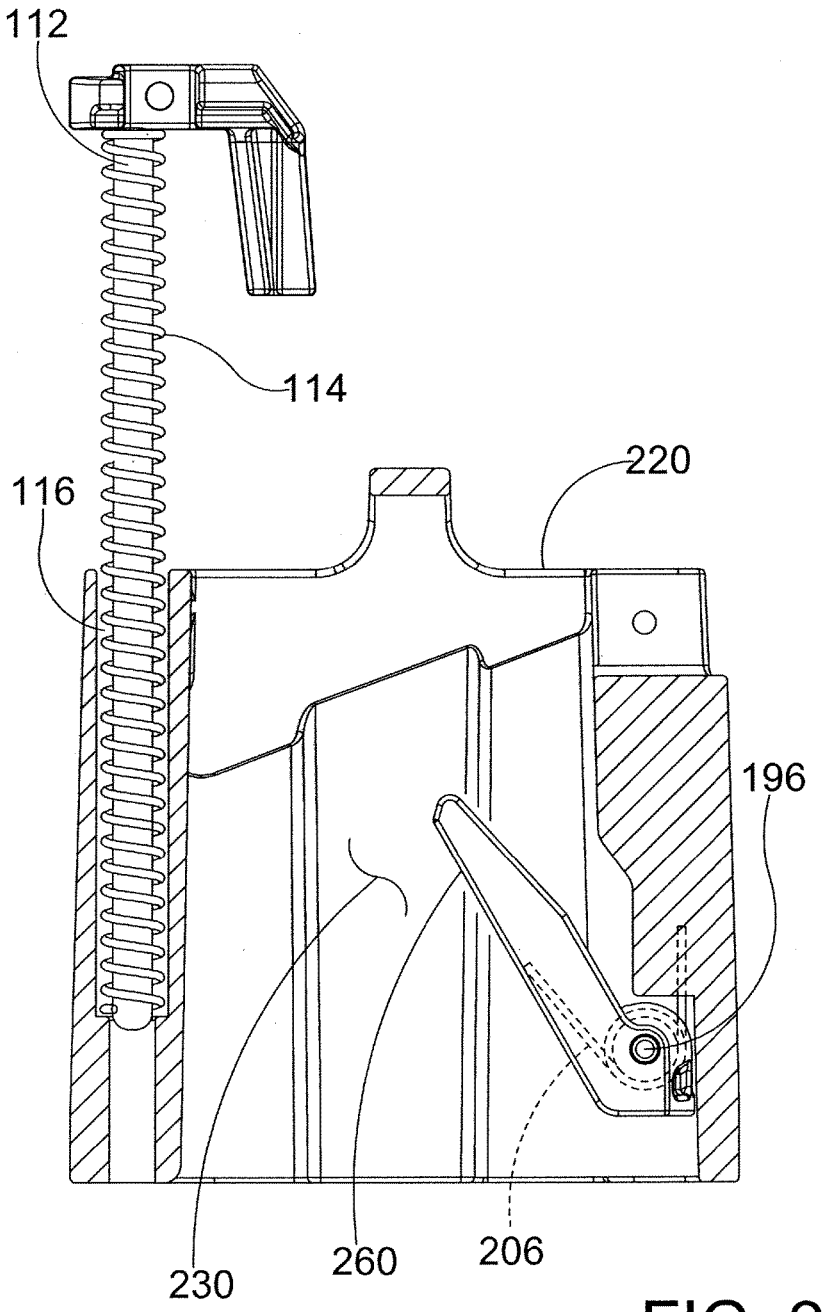
FIG. 24 is a cross-sectional view of an assembly including the sleeve, rod and coil spring of the magazine loader shown in FIG. 23. The assembly is sectioned along section line 24-24 shown in FIG. 23.
Figures 25A, 25B:
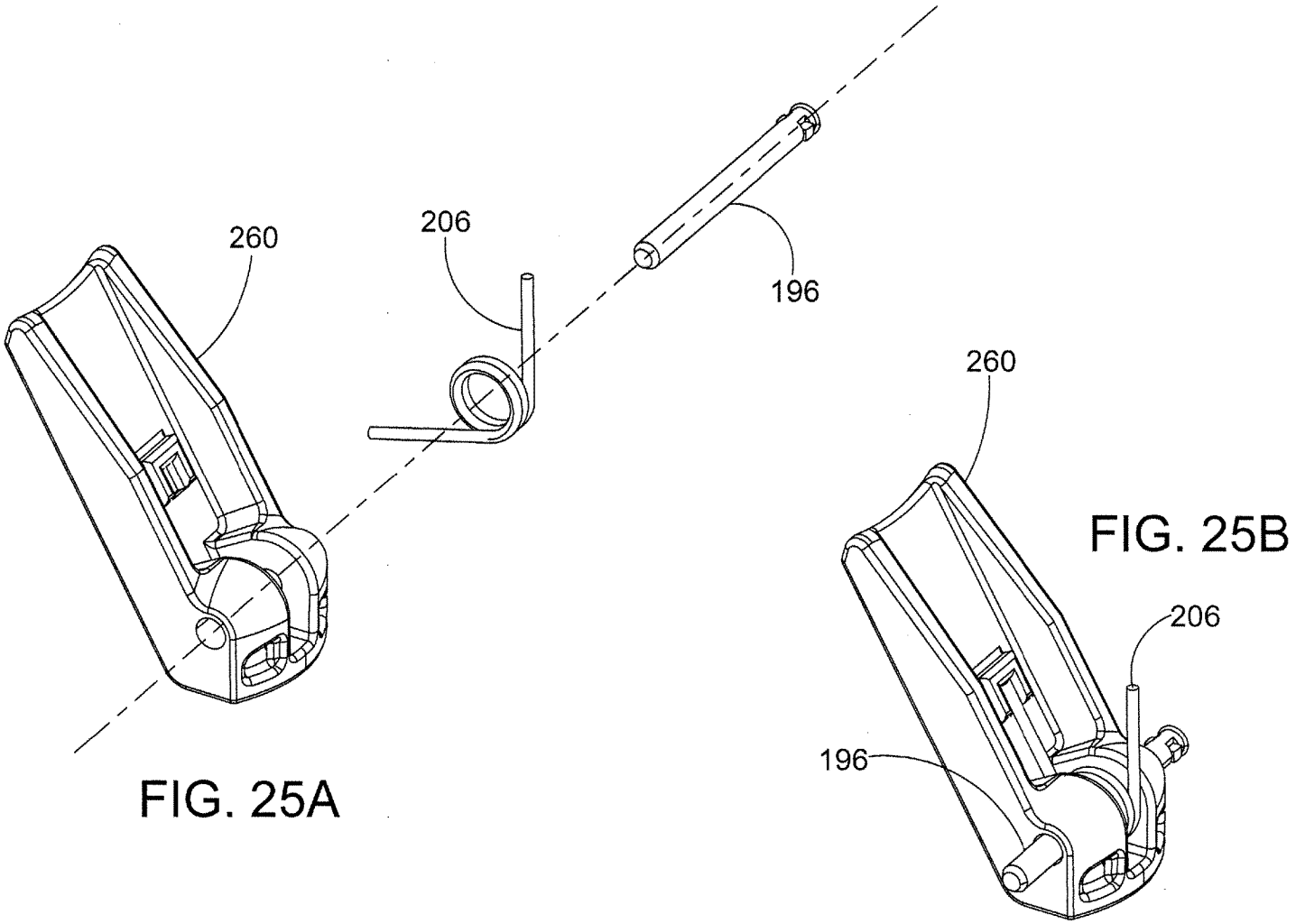
FIG. 25A is an exploded perspective view of an assembly including a lever, a spring and an axle.
FIG. 25B is a perspective view showing the assembly of FIG. 26A in an assembled state.
Figure 26:
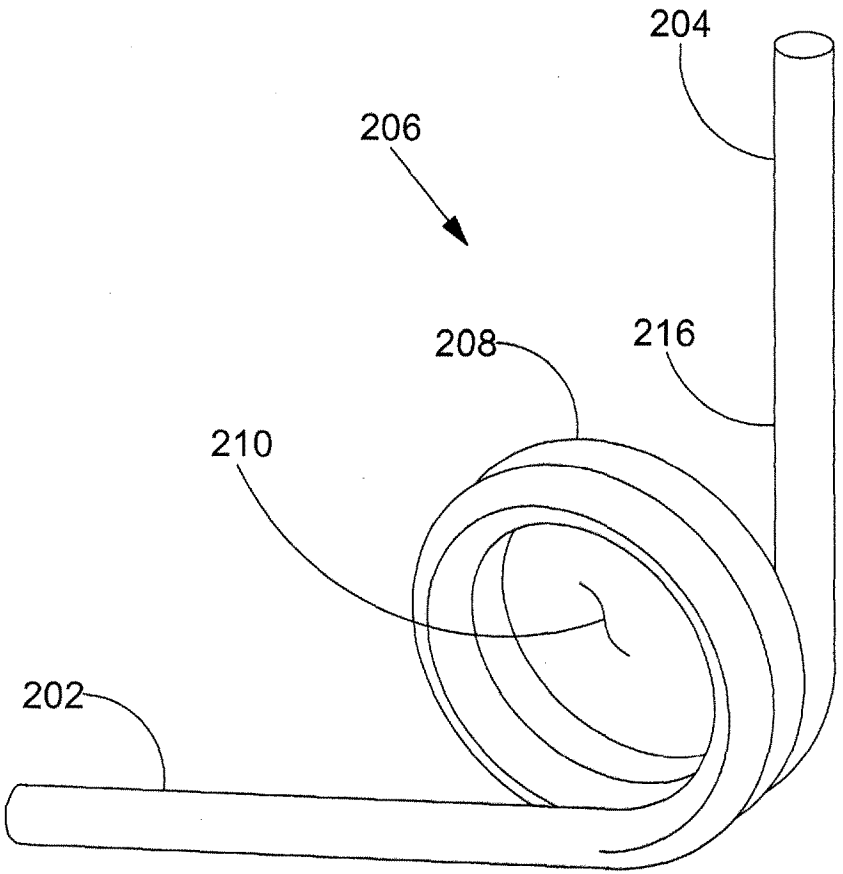
FIG. 26 is a perspective view further illustrating the spring shown in FIGS. 26A and 26B.

Referring, for example to FIGS. 22-24, the body 120 may include a rod and the sleeve 220 may define a passageway 116. The rod 112 may extend in a downward direction into the passageway 116 defined by the sleeve 220. In some embodiments, the rod 112 of the body 120 is fixed to the panel 150 of the body 120 with the rod 112 extending downwardly beyond a downward facing surface of to the panel 150. The magazine loader 100 may include a coil spring 114 comprising a spring wire dispose about the rod 112. The coil spring 114 may have an upper end seated against the body 120 and a lower end seated against the sleeve 220. In some useful embodiments, the coil spring 114 urges the body 120 to translate toward the upper position.

Referring, for example, to FIGS. 3-7, 22 and 23, an upward direction Z and a downward or lower direction −Z are illustrated using arrows labeled "Z" and "−Z," respectively. A forward direction Y and a rearward direction −Y are illustrated using arrows labeled "Y" and "−Y," respectively. A starboard direction X and a port direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZX plane defined by the upward direction and the starboard direction. In one or more embodiments, the starboard direction is generally opposite the port direction. In one or more embodiments, starboard direction and the port direction are both generally orthogonal to a ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

Figure 27A:
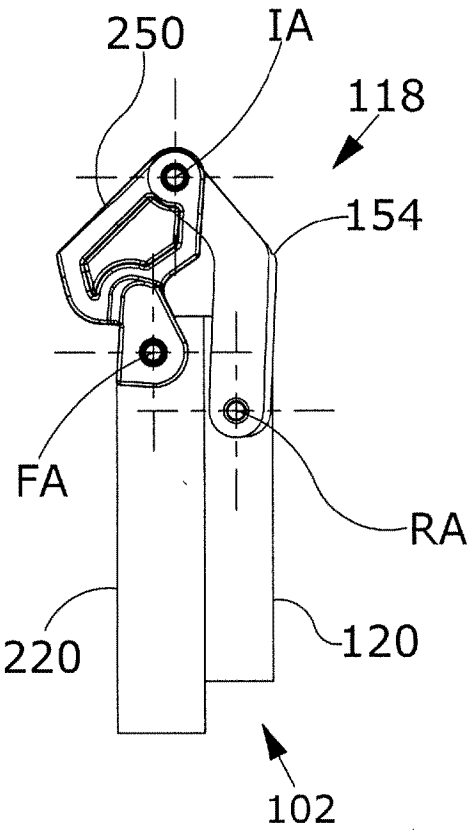
FIG. 27A, FIG. 27B and FIG. 27C are a sequence of stylized section views illustrating the operation of a setting mechanism in accordance with the detailed description. In the embodiment of FIG. 27A the body of the setting mechanism is disposed in a lowermost position. In the embodiment of FIG. 27C, the body of the setting mechanism is disposed in an uppermost position.
Figure 27B:
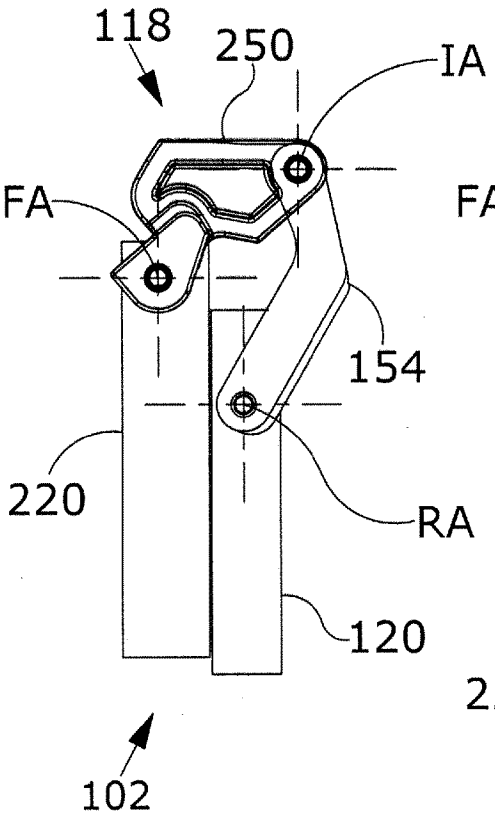
Figure 27C:
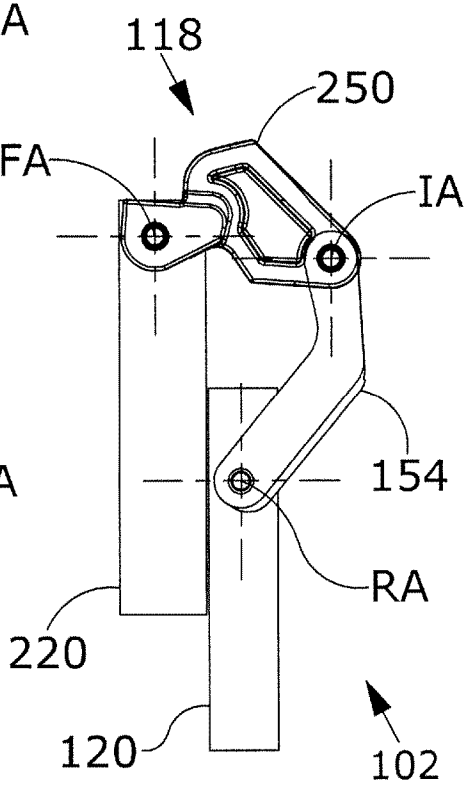
Figure 28:
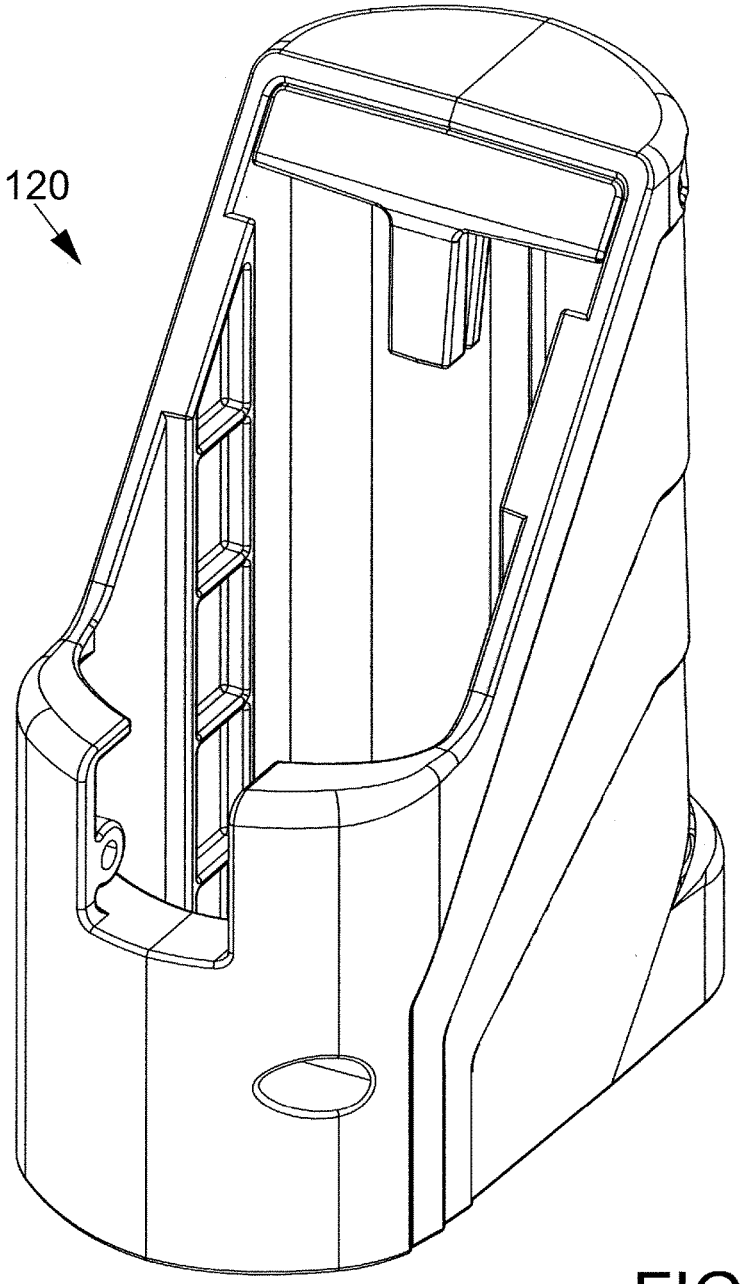
FIG. 28 is a front, right, top perspective view of a magazine loader portion.
Figure 29:
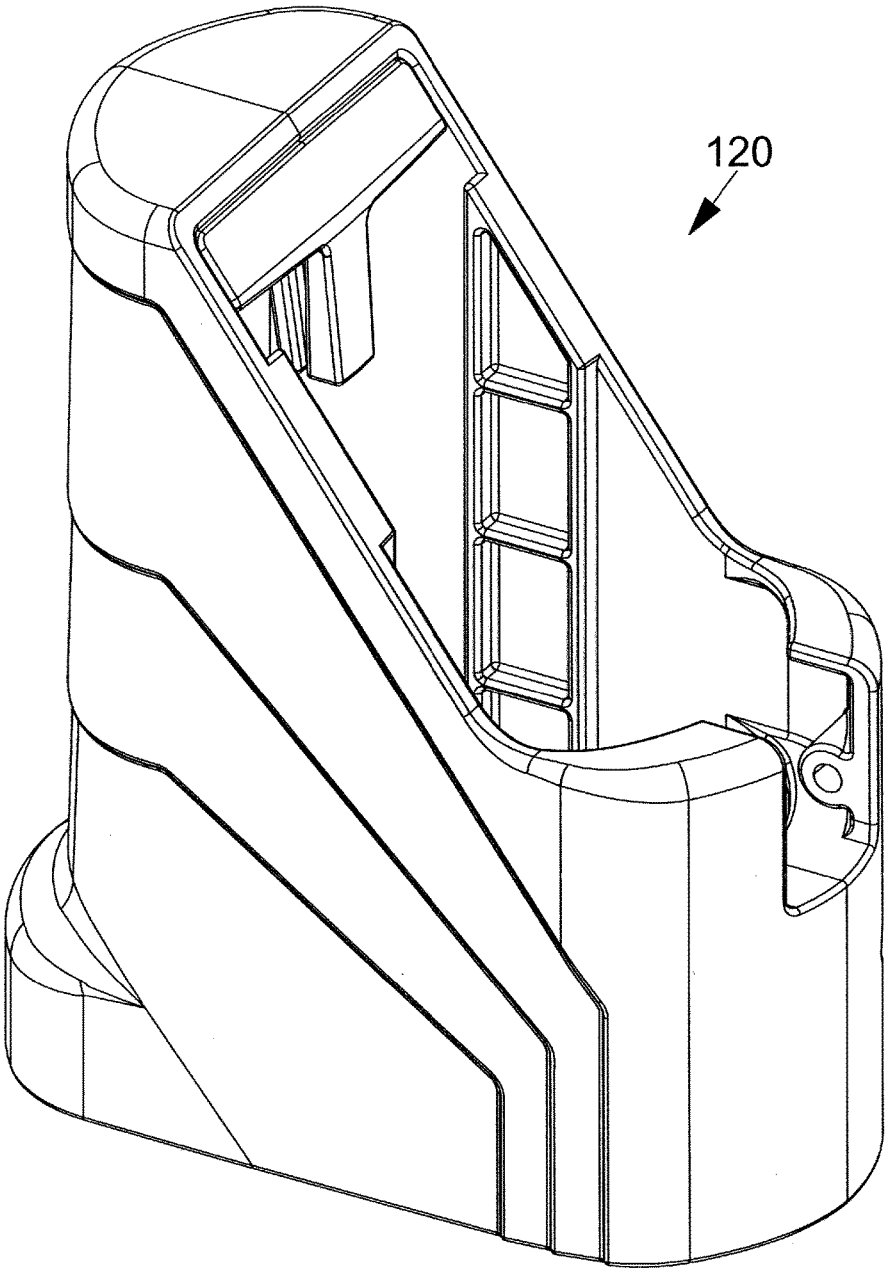
FIG. 29 is a front, left, top perspective view of a magazine loader portion.
Figure 30:
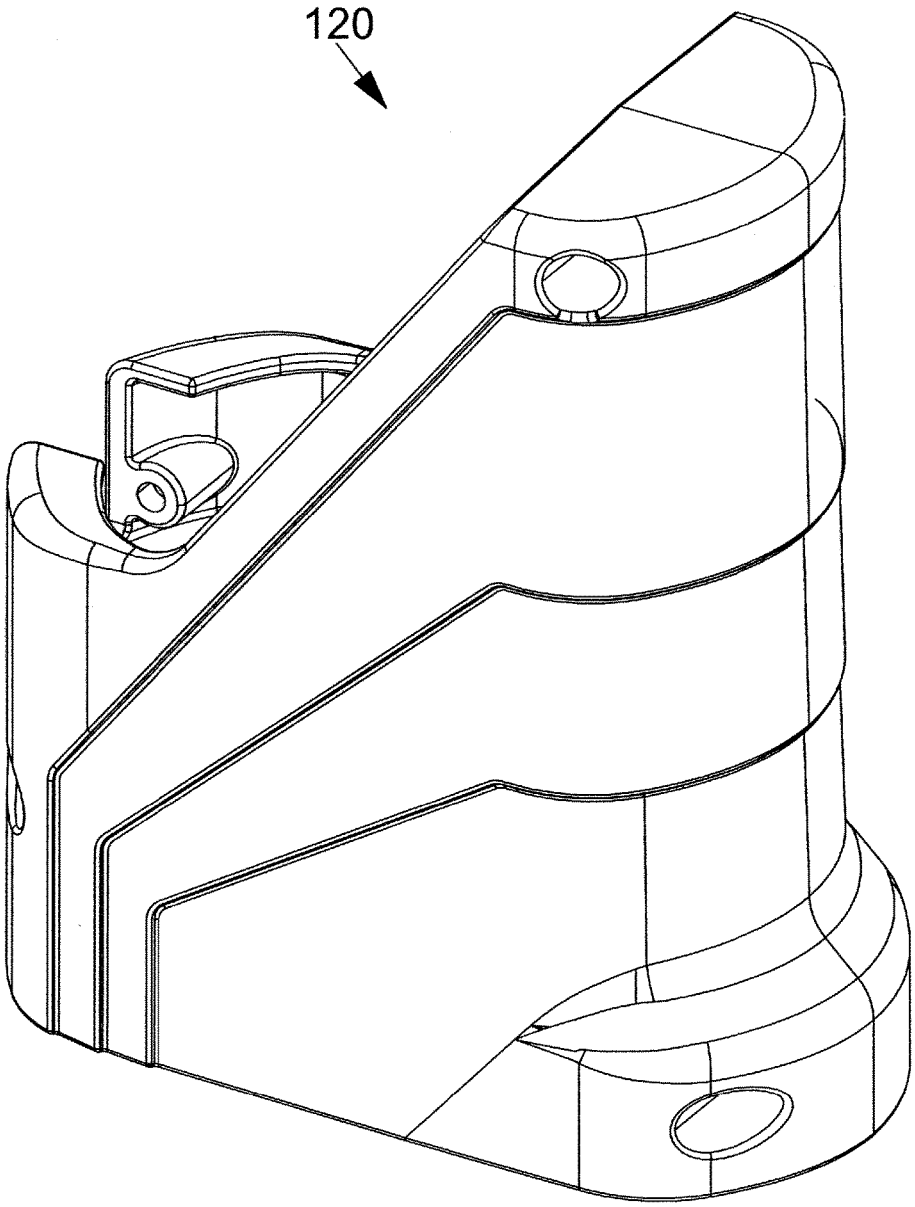
FIG. 30 is a rear, right, top perspective view of a magazine loader portion.
Figure 31:
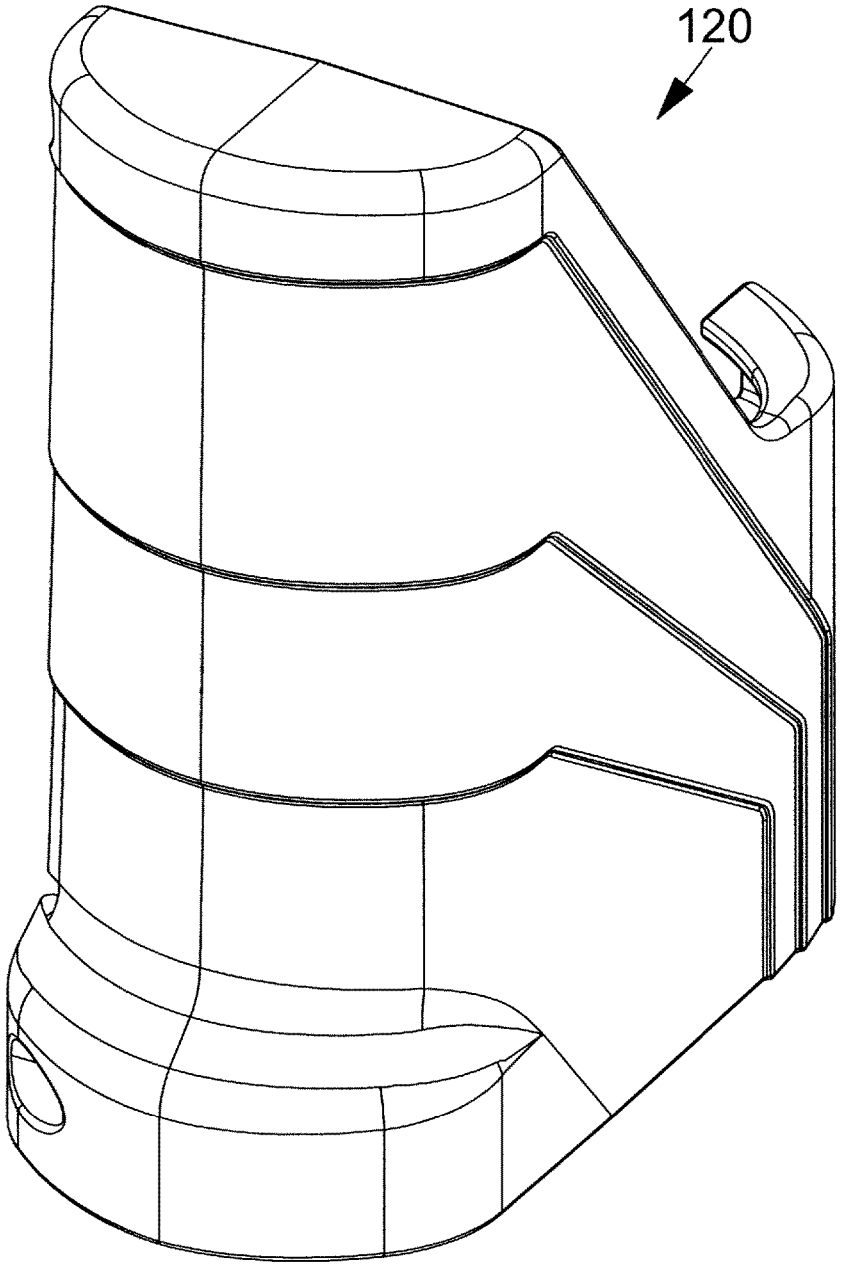
FIG. 31 is a rear, left, top perspective view of a magazine loader portion.

Referring, for example, to FIGS. 27A, 27B and 27C, a magazine loader 100 for loading cartridges into a magazine may comprise a bar-linkage 118 including a first bar member, a second bar member, a third bar member, and a fourth bar member. A first end of the second bar member may be pivotally coupled to the first bar member for rotation of the second bar member with respect to the first bar member about a first axis FA. A second end of the second bar member may be pivotally coupled to a first end of the third bar member for relative rotation between the second bar member and the third bar member about a second axis IA. A second end of the third bar member may be pivotally coupled to the fourth bar member for rotation of the third bar member with respect to the fourth bar member about a third axis RA. In some embodiments, the first bar member comprises sleeve 220 comprising a plurality of sleeve wall portions defining a sleeve cavity. The sleeve cavity may be configured to receive an upper portion of the magazine and the sleeve cavity may extend along a magazine insertion and withdrawal axis. In some embodiments, the fourth bar member comprises a body 120 that is slidingly disposed about the sleeve 220 so that the body 120 and the sleeve 220 can slide relative to one another along a sliding axis. The sliding axis extends in upward and downward directions in some applications. The body 120 may translate along the sliding axis between an upper position and a lower position. In some embodiments, the second bar member comprising a setting tool 250. In some embodiments, when the body translates upwardly with respect to the sleeve, the setting tool rotates about the first axis and a cartridge engagement portion of the setting tool swings inwardly in a cartridge insertion motion as the body translates between the lower position and the upper position. In some example embodiments, the third bar member comprises a link 154.

The following United States patents are hereby incorporated by reference herein: U.S. Pat. No. 4,464,855, U.S. Pat. No. 4,689,909, U.S. Pat. No. 4,719,715, U.S. Pat. No. 4,827,651, U.S. Pat. No. 4,829,693, U.S. Pat. No. 4,888,902, U.S. Pat. No. 4,993,180, U.S. Pat. No. 5,249,386, U.S. Pat. No. 5,355,606, U.S. Pat. No. 5,377,436, U.S. Pat. No. 6,178,683, U.S. Pat. No. 6,817,134, U.S. Pat. No. 7,257,919, U.S. Pat. No. 7,383,657, U.S. Pat. No. 7,503,138, U.S. Pat. No. 7,637,048, U.S. Pat. No. 7,805,874, and U.S. Pat. No. 9,212,859.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention. The inventors of the magazine loaders described herein are associated with Fred Sparks Design of St. Louis, Mo.

What is claimed is:

1. An apparatus for loading cartridges into a magazine, comprising:

a sleeve defining a sleeve cavity configured to receive an upper portion of the magazine, the sleeve cavity extending along a magazine insertion and withdrawal axis;

a body slidingly disposed about the sleeve so that the body and the sleeve can slide relative to one another along a sliding axis, the sliding axis being generally parallel to the magazine insertion and withdrawal axis, each axis extending in an upward direction and a downward direction;

a setting tool pivotally coupled to the sleeve at a first end thereof so that the setting tool rotates about a first axis relative to the sleeve, the first axis extending in a portward direction and a starboard direction;

a link operatively coupled between the setting tool and the body, a first end of the link being pivotally coupled to a second end of the setting tool and a second end of the link being pivotally coupled to the body;

wherein the setting tool rotates about the first axis as the body translates upwardly and downwardly with respect to the sleeve.

2. The apparatus of claim 1 wherein the second end of the setting tool translates rearwardly and upwardly, then rearwardly and downwardly, as the setting tool rotates about the first axis and the body translates upward, relative to the sleeve, from a lower position toward an upper position.

3. The apparatus of claim 1 wherein the second end of the setting tool translates forwardly and upwardly, then forwardly and downwardly, as the setting tool rotates about the first axis and the body translates downward, relative to the sleeve, from an upper position toward a lower position.

4. The apparatus of claim 1 wherein the setting tool rotates about the first axis and a cartridge engagement portion of the setting tool swings inwardly in a cartridge seating motion as the body translates, relative to the sleeve, between a lower position and a upper position.

5. The apparatus of claim 1 further comprising a spring urging the body to translate toward an upper position.

6. The apparatus of claim 1 further comprising a spring having an upper end seated against the body and a lower end seated against the sleeve, the spring urging the body to translate toward an upper position.

7. The apparatus of claim 1 wherein a given point on a cartridge engagement portion of the setting tool translates along an arc shaped path as the setting tool rotates about the first axis.

8. The apparatus of claim 1 wherein the cartridge engagement portion of the setting tool travels rearward and upward as the cartridge engagement portion of the setting tool translates along the arc shaped path then travels rearward and downward as the cartridge engagement portion of the setting tool translates further along the arc shaped path.

9. The apparatus of claim 1 wherein the sleeve comprises a front sleeve wall portion disposed opposite a rear sleeve wall portion, a starboard sleeve wall portion extending in a forward direction from the rear sleeve wall portion to the front sleeve wall portion, a port sleeve wall portion extending in a forward direction from the rear sleeve wall portion to the front sleeve wall portion, sleeve inner surfaces of the sleeve wall portions defining a sleeve cavity, the sleeve cavity being dimensioned and adapted to receive an upper portion of the magazine, the front and rear sleeve wall portions extending in a starboard direction from the port sleeve wall portion to the starboard sleeve wall portion.

10. The apparatus of claim 9, further comprising a lever disposed inside a cavity defined by the sleeve for urging the magazine against the front sleeve wall portion, the lever being pivotally supported by an axle, the axle extending through a first puncture defined by the starboard sleeve wall portion and a second puncture defined by the port sleeve wall portion, the spring comprising a length of wire, the wire of the spring forming a first leg, a second leg and a coil disposed between the first leg and the second leg, the coil defining a lumen, the first leg of the spring being seated against the lever and the second leg of the spring being seated against the sleeve, the axle extending through the lumen disposed between the first leg and the second leg.

11. A magazine loader for loading cartridges into a magazine, comprising:

a sleeve defining a sleeve cavity configured to receive an upper portion of the magazine, the sleeve cavity extending along a magazine insertion and withdrawal axis;

a body slidingly disposed about the sleeve so that the body can translate along a sliding axis between an upper position and a lower position along the sliding axis, the sliding axis being generally parallel to the magazine insertion and withdrawal axis, each axis extending in an upward direction and a downward direction;

a setting tool pivotally coupled to the sleeve at a first end thereof so that the setting tool rotates about a first axis relative to the sleeve, the first axis extending in a portward direction and a starboard direction;

the magazine loader providing access to a cartridge receiving opening as the body of the magazine loader is urged downward from the upper position;

the setting tool pivoting about the first axis and a cartridge engagement portion of the setting tool swinging inwardly in a cartridge seating motion as the body translates upward toward the upper position.

12. The apparatus of claim 1 wherein a second end of the setting tool translates rearwardly and upwardly, then rearwardly and downwardly, as the setting tool pivots about the first axis and the body translates upward, relative to the sleeve, from the lower position toward the upper position.

13. The apparatus of claim 12 wherein the second end of the setting tool translates forwardly and upwardly, then forwardly and downwardly, as the setting tool pivots about the first axis and the body translates downward, relative to the sleeve, from the upper position toward the lower position.

14. The apparatus of claim 13 wherein the second end of the setting tool translates in a rearward direction and a forward direction that are each orthogonal to a plane defined by the upward direction and the portward direction.

15. The apparatus of claim 11 further comprising a spring having an upper end seated against the body and a lower end seated against the sleeve, the spring urging the body to translate toward the upper position.

* * * * *